US011094258B2

(12) United States Patent
Park et al.

(10) Patent No.: US 11,094,258 B2
(45) **Date of Patent: *Aug. 17, 2021**

(54) PIXEL CIRCUIT

(71) Applicant: Samsung Display Co., Ltd., Yongin-si (KR)

(72) Inventors: Sehyuk Park, Seongnam-si (KR); Joon-Chul Goh, Suwon-si (KR); Sangan Kwon, Cheonan-si (KR); Jinyoung Roh, Hwaseong-si (KR); Hyojin Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/932,031

(22) Filed: Jul. 17, 2020

(65) Prior Publication Data

US 2021/0049959 A1 Feb. 18, 2021

(30) Foreign Application Priority Data

Aug. 16, 2019 (KR) ..... 10-2019-0100339

(51) Int. Cl.
*G09G 3/325* (2016.01)
*G09G 3/3275* (2016.01)

(52) U.S. Cl.
CPC ..... *G09G 3/325* (2013.01); *G09G 3/3275* (2013.01); *G09G 2310/0272* (2013.01)

(58) Field of Classification Search
CPC ..... G09G 3/325; G09G 3/3275; G09G 2310/0272; G09G 2310/0262;
(Continued)

(56) References Cited

U.S. PATENT DOCUMENTS 9,349,321 B2 * 5/2016 Chen ..... G09G 3/3291
9,823,729 B2 * 11/2017 An ..... G09G 3/3233
(Continued)

FOREIGN PATENT DOCUMENTS

KR 10-2013-0118459 A 10/2013
KR 10-2016-0096787 A 8/2016
(Continued)

OTHER PUBLICATIONS

U.S. Notice of Allowance dated Dec. 17, 2020, issued in U.S. Appl. No. 16/943,293 (10 pages).

*Primary Examiner* — Ibrahim A Khan
(74) *Attorney, Agent, or Firm* — Lewis Roca Rothgerber Christie LLP

(57) ABSTRACT

A pixel circuit includes: a main circuit including: a driving transistor that includes a gate terminal connected to a first node, a first terminal connected to a second node, and a second terminal connected to a third node; and an organic light-emitting element connected to the driving transistor and configured to control the organic light-emitting element by controlling a driving current corresponding to a data signal applied via a data line to flow into the organic light-emitting element; and a sub circuit including: a first compensation transistor that includes a gate terminal configured to receive a first gate signal, a first terminal connected to the first node, and a second terminal connected to a fourth node; and a second compensation transistor that includes a gate terminal configured to receive a second gate signal, a first terminal connected to the fourth node, and a second terminal connected to the third node.

20 Claims, 15 Drawing Sheets

(58) Field of Classification Search
CPC ... G09G 2300/0819; G09G 2300/0861; G09G 2300/0842; G09G 2320/0247; G09G 2340/0435; G09G 3/3233
See application file for complete search history.

(56) References Cited

U.S. PATENT DOCUMENTS

| | | | | |
|---|---|---|---|---|
| 10,490,128 | B1 * | 11/2019 | Qian | G09G 3/3233 |
| 2011/0134100 | A1 * | 6/2011 | Chung | G09G 3/325 345/212 |
| 2012/0105390 | A1 * | 5/2012 | Kim | G09G 3/003 345/204 |
| 2013/0038621 | A1 * | 2/2013 | Choi | G06T 1/60 345/589 |
| 2014/0092078 | A1 * | 4/2014 | Yoon | G09G 3/3696 345/212 |
| 2015/0287361 | A1 * | 10/2015 | Lee | G09G 3/3233 315/172 |
| 2016/0232849 | A1 * | 8/2016 | Jeon | G09G 3/3233 |
| 2016/0321994 | A1 * | 11/2016 | Lee | G09G 3/2003 |
| 2017/0004772 | A1 * | 1/2017 | Han | H01L 27/326 |
| 2017/0011685 | A1 * | 1/2017 | Jeon | H01L 27/3272 |
| 2017/0092178 | A1 * | 3/2017 | Lee | G09G 3/3233 |
| 2017/0098413 | A1 * | 4/2017 | Lee | G11C 19/28 |
| 2017/0140724 | A1 | 5/2017 | Lin et al. | |
| 2017/0148384 | A1 * | 5/2017 | Lee | G09G 3/3233 |
| 2017/0256199 | A1 * | 9/2017 | Bi | G09G 3/20 |
| 2018/0158407 | A1 * | 6/2018 | Chai | G09G 3/3275 |
| 2018/0166010 | A1 * | 6/2018 | Park | G09G 3/3233 |
| 2018/0174514 | A1 * | 6/2018 | Lee | G09G 3/3233 |
| 2019/0147799 | A1 | 5/2019 | Kim et al. | |
| 2020/0226978 | A1 * | 7/2020 | Lin | H01L 27/3262 |

FOREIGN PATENT DOCUMENTS

| | | | |
|---|---|---|---|
| KR | 10-2018-0063425 | A | 6/2018 |
| KR | 10-2019-0012303 | A | 2/2019 |

* cited by examiner

PIXEL CIRCUIT

CROSS-REFERENCE TO RELATED APPLICATION(S)

The present application claims priority to and the benefit of Korean Patent Application No. 10-2019-0100339, filed on Aug. 16, 2019 in the Korean Intellectual Property Office (KIPO), the contents of which are incorporated herein in its entirety by reference.

BACKGROUND

1. Field

Aspects of some example embodiments relate generally to a pixel circuit.

2. Description of the Related Art

Generally, a pixel circuit included in an organic light-emitting display device may include an organic light-emitting element, a storage capacitor, a switching transistor, a driving transistor, an emission control transistor, a compensation transistor, an initialization transistor, etc. When low temperature poly silicon (LTPS) transistors are utilized in a pixel circuit of an organic light-emitting display device, a flicker may occur when the organic light-emitting display device is driven at less than a specific driving frequency (e.g., at less than 30 hertz (Hz)).

In other words, because a leakage current flows through the transistors even when the transistors are turned off, a data signal stored in the storage capacitor (i.e., a voltage of a gate terminal of the driving transistor) may be changed by the leakage current when the organic light-emitting display device operates in a low-frequency driving mode, and thus a viewer (or user) may perceive unintended luminance-changes that may degrade the perceived display quality.

For example, when the pixel circuit has a structure in which an initializing operation, a threshold voltage compensating and data writing operation, and a light-emitting operation are sequentially performed (e.g., a structure in which the gate terminal of the driving transistor, one terminal of the storage capacitor, one terminal of the initialization transistor, and one terminal of the compensation transistor are connected at a specific node), the data signal stored in the storage capacitor (i.e., the voltage of the gate terminal of the driving transistor) may be changed because the leakage current flows through the compensation transistor and the initialization transistor even when the compensation transistor and the initialization transistor are turned off. Thus, a pixel circuit may reduce the leakage current flowing through the compensation transistor and the initialization transistor by including the compensation transistor having a dual structure and the initialization transistor having a dual structure. However, the pixel circuit may have a limit that an effect of reducing the leakage current is slight when the organic light-emitting display device operates in the low-frequency driving mode.

The above information disclosed in this Background section is only for enhancement of understanding of the background and therefore the information discussed in this Background section does not necessarily constitute prior art.

SUMMARY

For example, some example embodiments of the present inventive concept relate to a pixel circuit including an organic light-emitting element (e.g., an organic light-emitting diode), a storage capacitor, a switching transistor, a driving transistor, an emission control transistor, a compensation transistor, an initialization transistor, etc.

Aspects of some example embodiments provide a pixel circuit capable of preventing or reducing a flicker that a viewer can recognize or perceive by minimizing (or reducing) a change in a voltage of a gate terminal of a driving transistor, which is caused by a leakage current flowing through a compensation transistor and an initialization transistor when an organic light-emitting display device operates in a low-frequency driving mode According to an aspect of some example embodiments, a pixel circuit may include a main circuit including a driving transistor that includes a gate terminal that is connected to a first node, a first terminal that is connected to a second node, and a second terminal that is connected to a third node and an organic light-emitting element that is connected to the driving transistor between a first power voltage and a second power voltage and configured to control the organic light-emitting element to emit light by controlling a driving current corresponding to a data signal that is applied via a data line to flow into the organic light-emitting element; and a sub circuit including a first compensation transistor that includes a gate terminal that receives a first gate signal, a first terminal that is connected to the first node, and a second terminal that is connected to a fourth node and a second compensation transistor that includes a gate terminal that receives a second gate signal, a first terminal that is connected to the fourth node, and a second terminal that is connected to the third node. Here, in a low-frequency driving mode, a driving frequency of the first gate signal may be N Hz, where N is a positive integer, a driving frequency of the second gate signal may be M Hz, which is a driving frequency of an organic light-emitting display device, where M is a positive integer and different from N, the first compensation transistor may be turned on during a predetermined time in N non-light-emitting periods per second, and the second compensation transistor may be turned on during a predetermined time in M non-light-emitting periods per second.

According to some example embodiments, in the low-frequency driving mode, the driving frequency of the first gate signal may be higher than the driving frequency of the second gate signal.

According to some example embodiments, the first gate signal and the second gate signal may be generated by respective signal generating circuits that are independent of each other.

According to some example embodiments, the sub circuit may further include a first initialization transistor including a gate terminal that receives a first initialization signal, a first terminal that is connected to the first node, and a second terminal that is connected to a fifth node and a second initialization transistor including a gate terminal that receives a second initialization signal, a first terminal that is connected to the fifth node, and a second terminal that receives an initialization voltage. According to some example embodiments, in the low-frequency driving mode, a driving frequency of the first initialization signal may be N Hz, a driving frequency of the second initialization signal may be M Hz, the first initialization transistor may be turned on during a predetermined time in N non-light-emitting periods per second, and the second initialization transistor may be turned on during a predetermined time in M non-light-emitting periods per second.

According to some example embodiments, the first initialization signal and the second initialization signal may be generated by respective signal generating circuits that are independent of each other.

According to some example embodiments, in a normal non-light-emitting period in which an initializing operation and a threshold voltage compensating and data writing operation are performed, the first compensation transistor and the second compensation transistor may be turned on and then off after the first initialization transistor and the second initialization transistor are turned on and then off.

According to some example embodiments, in a hold non-light-emitting period in which the initializing operation and the threshold voltage compensating and data writing operation are not performed, the first compensation transistor may be turned on and then off after the first initialization transistor is turned on and then off.

According to some example embodiments, the sub circuit may further include an initialization transistor including a gate terminal that receives an initialization signal, a first terminal that is connected to the first node, and a second terminal that receives an initialization voltage. Here, in the low-frequency driving mode, a driving frequency of the initialization signal may be M Hz, and the initialization transistor may be turned on during a predetermined time in M non-light-emitting periods per second.

According to some example embodiments, in a normal non-light-emitting period in which an initializing operation and a threshold voltage compensating and data writing operation are performed, the first compensation transistor and the second compensation transistor may be turned on and then off after the initialization transistor is turned on and then off.

According to some example embodiments, in a hold non-light-emitting period in which the initializing operation and the threshold voltage compensating and data writing operation are not performed, the first compensation transistor may be turned on and then off.

According to some example embodiments, the main circuit may further include a switching transistor including a gate terminal that receives the first gate signal, a first terminal that is connected to the data line, and a second terminal that is connected to the second node, a storage capacitor including a first terminal that receives the first power voltage and a second terminal that is connected to the first node, a first emission control transistor including a gate terminal that receives a first emission control signal, a first terminal that receives the first power voltage, and a second terminal that is connected to the second node, and a second emission control transistor including a gate terminal that receives a second emission control signal, a first terminal that is connected to the third node, and a second terminal that is connected to an anode of the organic light-emitting element.

According to some example embodiments, the sub circuit may further include a bypass transistor including a gate terminal that receives a bypass signal, a first terminal that receives the initialization voltage, and a second terminal that is connected to an anode of the organic light-emitting element.

According to an aspect of some example embodiments, a pixel circuit may include a main circuit including a driving transistor that includes a gate terminal that is connected to a first node, a first terminal that is connected to a second node, and a second terminal that is connected to a third node and an organic light-emitting element that is connected to the driving transistor between a first power voltage and a second power voltage and configured to control the organic light-emitting element to emit light by controlling a driving current corresponding to a data signal that is applied via a data line to flow into the organic light-emitting element, and a sub circuit including a first initialization transistor that includes a gate terminal that receives a first initialization signal, a first terminal that is connected to the first node, and a second terminal that is connected to a fifth node, a second initialization transistor that includes a gate terminal that receives a second initialization signal, a first terminal that is connected to the fifth node, and a second terminal that receives an initialization voltage, and a compensation transistor that includes a gate terminal that receives a gate signal, a first terminal that is connected to the first node, and a second terminal that is connected to the third node. Here, in a low-frequency driving mode, a driving frequency of the first initialization signal may be N Hz, where N is a positive integer, a driving frequency of the second initialization signal may be M Hz, which is a driving frequency of an organic light-emitting display device, where M is a positive integer and different from N, a driving frequency of the gate signal may be M Hz, the first initialization transistor may be turned on during a predetermined time in N non-light-emitting periods per second, the second initialization transistor may be turned on during a predetermined time in M non-light-emitting periods per second, and the compensation transistor may be turned on during a predetermined time in M non-light-emitting periods per second.

According to some example embodiments, in the low-frequency driving mode, the driving frequency of the first initialization signal may be higher than the driving frequency of the second initialization signal.

According to some example embodiments, the first initialization signal and the second initialization signal may be generated by respective signal generating circuits that are independent of each other.

According to some example embodiments, in the low-frequency driving mode, the driving frequency of the first initialization signal may be higher than the driving frequency of the gate signal.

According to some example embodiments, in a normal non-light-emitting period in which an initializing operation and a threshold voltage compensating and data writing operation are performed, the first initialization transistor may be turned on and then off.

According to some example embodiments, in a hold non-light-emitting period in which the initializing operation and the threshold voltage compensating and data writing operation are not performed, the first compensation transistor may be turned on and then off after the first initialization transistor is turned on and then off.

According to some example embodiments, the main circuit may further include a switching transistor including a gate terminal that receives the gate signal, a first terminal that is connected to the data line, and a second terminal that is connected to the second node, a storage capacitor including a first terminal that receives the first power voltage and a second terminal that is connected to the first node, a first emission control transistor including a gate terminal that receives a first emission control signal, a first terminal that receives the first power voltage, and a second terminal that is connected to the second node, and a second emission control transistor including a gate terminal that receives a second emission control signal, a first terminal that is connected to the third node, and a second terminal that is connected to an anode of the organic light-emitting element.

According to some example embodiments, the sub circuit may further include a bypass transistor including a gate terminal that receives a bypass signal, a first terminal that receives the initialization voltage, and a second terminal that is connected to an anode of the organic light-emitting element.

Therefore, a pixel circuit according to some example embodiments may have a structure including a first compensation transistor and a second compensation transistor that are connected in series between a gate terminal of a driving transistor and one terminal of the driving transistor (here, one terminal of the first compensation transistor is connected to the gate terminal of the driving transistor, and one terminal of the second compensation transistor is connected to the one terminal of the driving transistor) or a structure including a compensation transistor that is connected between the gate terminal of the driving transistor and the one terminal of the driving transistor. In addition, the pixel circuit may have a structure including a first initialization transistor and a second initialization transistor that are connected in series between the gate terminal of the driving transistor and an initialization voltage line transferring an initialization voltage (here, one terminal of the first initialization transistor is connected to the gate terminal of the driving transistor, and one terminal of the second initialization transistor is connected to the initialization voltage line transferring the initialization voltage) or a structure including an initialization transistor that is connected between the gate terminal of the driving transistor and the initialization voltage line transferring the initialization voltage.

Based on the structures, the pixel circuit may turn on the first compensation transistor and/or the first initialization transistor during a predetermined time in N non-light-emitting periods per second, where N is a positive integer, when an organic light-emitting display device operates in a low-frequency driving mode (i.e., a driving frequency of a first gate signal that controls the first compensation transistor and a driving frequency of a first initialization signal that controls the first initialization transistor may be N Hz, which is higher than a driving frequency of the organic light-emitting display device), and may turn on the second compensation transistor and/or the second initialization transistor during a predetermined time in M non-light-emitting periods per second, where M is a positive integer and different from N, when the organic light-emitting display device operates in the low-frequency driving mode (i.e., a driving frequency of a second gate signal that controls the second compensation transistor and a driving frequency of a second initialization signal that controls the second initialization transistor may be M Hz, which is the driving frequency of the organic light-emitting display device).

As a result, the pixel circuit may minimize (or reduce) a leakage current flowing through the first compensation transistor and/or the first initialization transistor when the organic light-emitting display device operates in the low-frequency driving mode and thus may prevent (or reduce) a flicker that a viewer can recognize (i.e., may prevent a change in a voltage of the gate terminal of the driving transistor).

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, aspects of some example embodiments of the present inventive concept will be explained in more detail with reference to the accompanying drawings.

Figure 1:
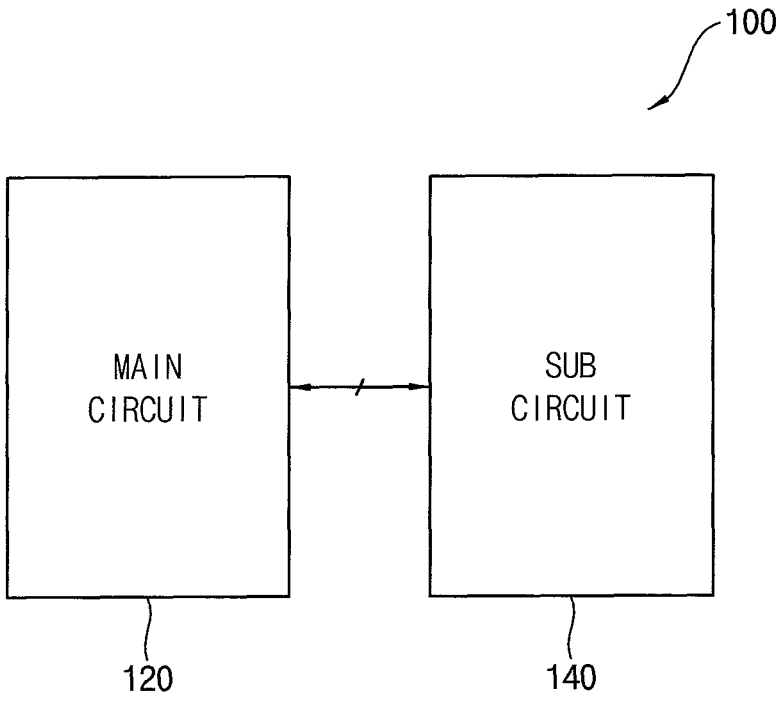
FIG. 1 is a block diagram illustrating a pixel circuit according to some example embodiments.
Figure 2:
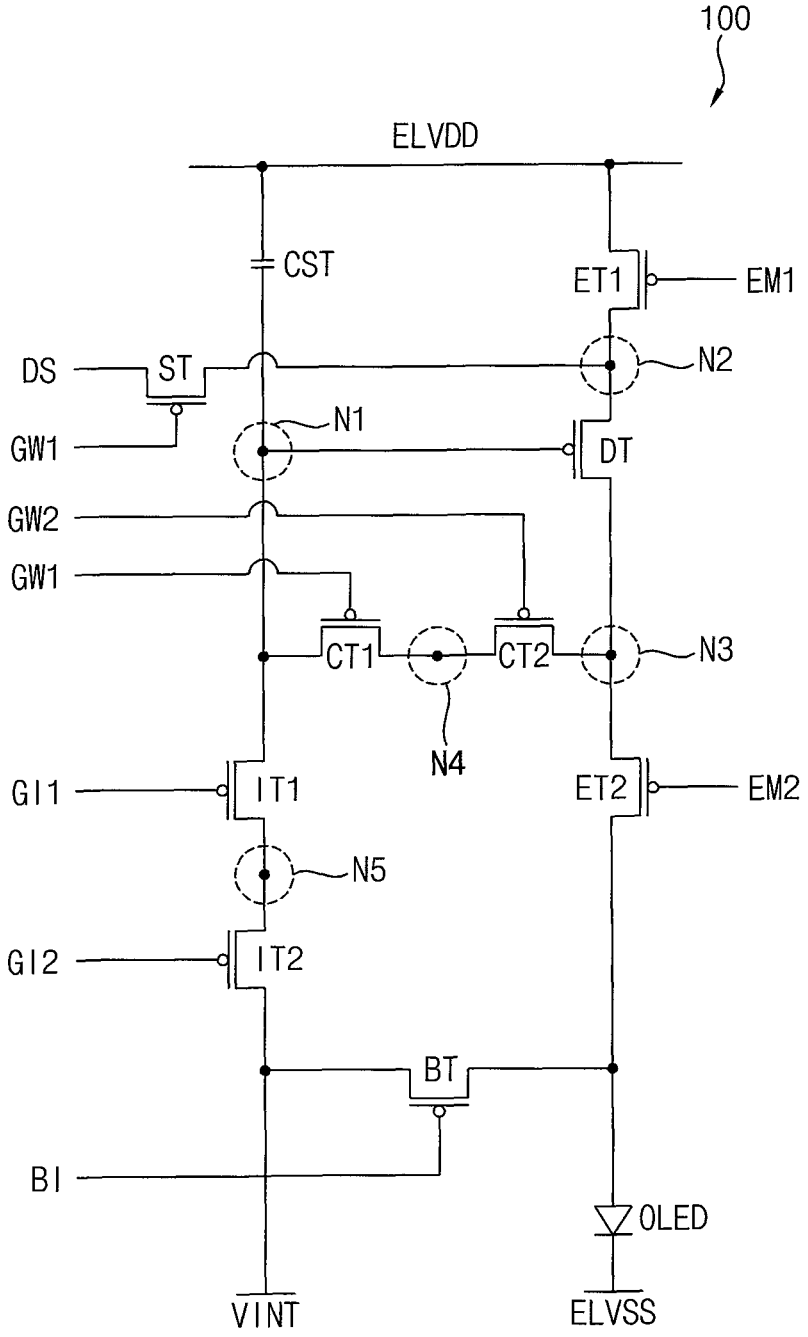
FIG. 2 is a circuit diagram illustrating an example of the pixel circuit of FIG. 1 according to some example embodiments.
Figure 3:
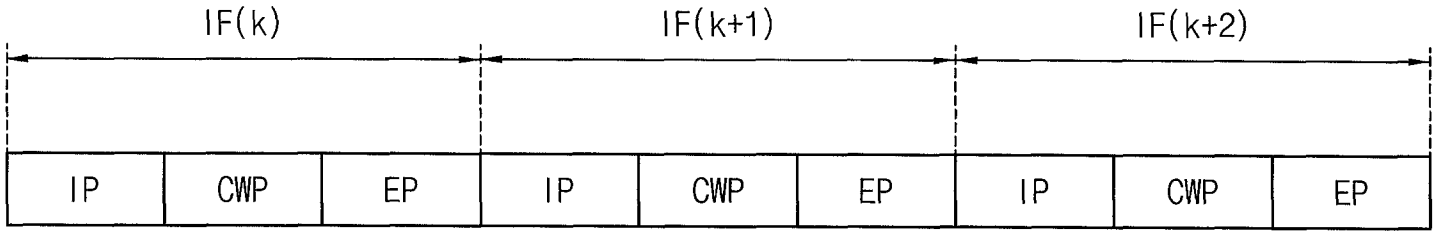
FIG. 3 is a diagram illustrating an example in which the pixel circuit of FIG. 2 operates according to some example embodiments.

FIG. 1 is a block diagram illustrating a pixel circuit according to some example embodiments, FIG. 2 is a circuit diagram illustrating an example of the pixel circuit of FIG. 1, and FIG. 3 is a diagram illustrating an example in which the pixel circuit of FIG. 2 operates.

Referring to FIGS. 1 to 3, the pixel circuit 100 may include a main circuit 120 and a sub circuit 140. For example, as illustrated in FIG. 3, the pixel circuit 100 may sequentially perform a non-light-emitting period (e.g., an initializing period IP and a threshold voltage compensating and data writing period CWP) and a light-emitting period EP in each image frame IF(k), IF(k+1), and IF(k+2). Here, the non-light-emitting period IP+CWP may correspond to a turn-off voltage level period of first and second emission control signals EM1 and EM2, and the light-emitting period EP may correspond to a turn-on voltage level period of the first and second emission control signals EM1 and EM2.

The main circuit 120 may include a driving transistor DT and an organic light-emitting element OLED that are connected in series between a first power voltage ELVDD and a second power voltage ELVSS. The main circuit 120 may control the organic light-emitting element OLED to emit light by controlling a driving current corresponding to a data signal DS that is applied via a data line to flow into the organic light-emitting element OLED. For example, as illustrated in FIG. 2, the main circuit 120 may include an organic light-emitting element OLED, a storage capacitor CST, a switching transistor ST, a driving transistor DT, a first emission control transistor ET1, and a second emission control transistor ET2.

The organic light-emitting element OLED may include an anode that is connected to a third node N3 via the second emission control transistor ET2 and a cathode that receives the second power voltage ELVSS. The storage capacitor CST may include a first terminal that receives the first power voltage ELVDD and a second terminal that is connected to a first node N1. The driving transistor DT may include a gate terminal that is connected to the first node N1, a first terminal that is connected to a second node N2, and a second terminal that is connected to the third node N3.

The switching transistor ST may include a gate terminal that receives a first gate signal GW1, a first terminal that is connected to the data line that transfers a data signal DS in response to the gate signal causing the switching transistor ST to turn on, and a second terminal that is connected to the second node N2. The first emission control transistor ET1 may include a gate terminal that receives the first emission control signal EM1, a first terminal that receives the first power voltage ELVDD, and a second terminal that is connected to the second node N2. The second emission control transistor ET2 may include a gate terminal that receives the second emission control signal EM2, a first terminal that is connected to the third node N3, and a second terminal that is connected to the anode of the organic light-emitting element OLED. Although it is illustrated in FIG. 2 that the first and second emission control transistors ET1 and ET2 are controlled by the first and second emission control signals EM1 and EM2, respectively (e.g., the first emission control transistor ET1 may be controlled by the first emission control signal EM1, and the second emission control transistor ET2 may be controlled by the second emission control signal EM2 that is delayed by a specific time from the first emission control signal EM1), in some example embodiments, the first emission control transistor ET1 and the second emission control transistor ET2 may be controlled by the same emission control signal. In some example embodiments, the main circuit 120 may include only one of the first emission control transistor ET1 and the second emission control transistor ET2.

The sub circuit 140 may include a first compensation transistor CT1 and a second compensation transistor CT2 that are connected in series between the first node N1 and the third node N3. For example, as illustrated in FIG. 2, the sub circuit 140 may include the first compensation transistor CT1, the second compensation transistor CT2, a first initialization transistor IT1, a second initialization transistor IT2, and a bypass transistor BT. The first compensation transistor CT1 may include a gate terminal that receives the first gate signal GW1, a first terminal that is connected to the first node N1, and a second terminal that is connected to the fourth node N4. The second compensation transistor CT2 may include a gate terminal that receives the second gate signal GW2, a first terminal that is connected to the fourth node N4, and a second terminal that is connected to the third node N3. Thus, the first compensation transistor CT1 and the second compensation transistor CT2 may be coupled in series between the first node N1 and the third node N3.

The first initialization transistor IT1 may include a gate terminal that receives a first initialization signal GI1, a first terminal that is connected to the first node N1, and a second terminal that is connected to a fifth node N5. The second initialization transistor IT2 may include a gate terminal that receives a second initialization signal GI2, a first terminal that is connected to the fifth node N5, and a second terminal that receives an initialization voltage VINT. The bypass transistor BT may include a gate terminal that receives a bypass signal BI, a first terminal that receives the initialization voltage VINT, and a second terminal that is connected to the anode of the organic light-emitting element OLED such that the initialization voltage VINT may be applied to the anode of the organic light-emitting element OLED in response to the bypass signal BI.

In some example embodiments, the bypass signal BI that controls the bypass transistor BT may be the same as the first initialization signal GI1 that controls the first initialization transistor IT1 or the second initialization signal GI2 that controls the second initialization transistor IT2. Here, in a low-frequency driving mode of the organic light-emitting display device (e.g., 30 Hz driving), a driving frequency of the first gate signal GW1 may be N Hz (e.g., 60 Hz), which is higher than a driving frequency of the organic light-emitting display device, where N is a positive integer, and a driving frequency of the second gate signal GW2 may be M Hz (e.g., 30 Hz), which is the driving frequency of the organic light-emitting display device, where M is a positive integer and different from M.

Thus, in the low-frequency driving mode of the organic light-emitting display device, the first compensation transistor CT1 that is controlled by the first gate signal GW1 may be turned on during a time (e.g., a set or predetermined time) in N non-light-emitting periods IP+CWP per second, and the second compensation transistor CT2 that is controlled by the second gate signal GW2 may be turned on during a time (e.g., a set or predetermined time) in M non-light-emitting periods IP+CWP per second. In addition, in the low-frequency driving mode of the organic light-emitting display device (e.g., 30 Hz driving), a driving frequency of the first initialization signal GI1 may be N Hz (e.g., 60 Hz), which is higher than the driving frequency of the organic light-emitting display device, and a driving frequency of the second initialization signal GI2 may be M Hz (e.g., 30 Hz), which is the driving frequency of the organic light-emitting display device. Thus, in the low-frequency driving mode of the organic light-emitting display device, the first initialization transistor IT1 that is controlled by the first initialization signal GI1 may be turned on during a time (e.g., a set or predetermined time) in N non-light-emitting periods IP+CWP per second, and the second initialization transistor IT2 that is controlled by the second initialization signal GI2 may be turned on during a time (e.g., a set or predetermined time) in M non-light-emitting periods IP+CWP per second.

According to some example embodiments, in the low-frequency driving mode of the organic light-emitting display device, the driving frequency of the first gate signal GW1 may be higher than the driving frequency of the second gate signal GW2, and the driving frequency of the first initialization signal GI1 may be higher than the driving frequency of the second initialization signal GI2. For example, when the driving frequency of the organic light-emitting display device is 30 Hz, the driving frequency of the first gate signal GW1 may be 60 Hz that is higher than the driving frequency of the organic light-emitting display device, and the driving frequency of the second gate signal GW2 may be 30 Hz that is the driving frequency of the organic light-emitting display device. In this case, the first compensation transistor CT1 that is controlled by the first gate signal GW1 may be turned on during a time (e.g., a set or predetermined time) in 60 non-light-emitting periods IP+CWP per second, and the second compensation transistor CT2 that is controlled by the second gate signal GW2 may be turned on during a time (e.g., a set or predetermined time) in 30 non-light-emitting periods IP+CWP per second. In addition, when the driving frequency of the organic light-emitting display device is 30 Hz, the driving frequency of the first initialization signal GI1 may be 60 Hz that is higher than the driving frequency of the organic light-emitting display device, and the driving frequency of the second initialization signal GI2 may be 30 Hz that is the driving frequency of the organic light-emitting display device. In this case, the first initialization transistor IT1 that is controlled by the first initialization signal GI1 may be turned on during a time (e.g., a set or predetermined time) in 60 non-light-emitting periods IP+CWP per second, and the second initialization transistor IT2 that is controlled by the second initialization signal GI2 may be turned on during a time (e.g., a set or predetermined time) in 30 non-light-emitting periods IP+CWP per second. Thus, the first initialization transistor IT1, the second initialization transistor IT2, the first compensation transistor CT1, and the second compensation transistor CT2 may be turned on and then off in a non-light-emitting period IP+CWP (e.g., referred to as a normal non-light-emitting period) of a first image frame, and only the first initialization transistor IT1 and the first compensation transistor CT1 may be turned on and then off in a non-light-emitting period IP+CWP (e.g., referred to as a hold non-light-emitting period) of a second image frame following the first image frame. These operations will be described in more detail below with reference to FIGS. 4 to 7.

Here, because the first gate signal GW1 and the second gate signal GW2 need to have different driving frequencies in the low-frequency driving mode of the organic light-emitting display device, the first gate signal GW1 and the second gate signal GW2 may be generated by respective signal generating circuits that are independent of each other. In addition, because the first initialization signal GI1 and the second initialization signal GI2 need to have different driving frequencies in the low-frequency driving mode of the organic light-emitting display device, the first initialization signal GI1 and the second initialization signal GI2 may be generated by respective signal generating circuits that are independent of each other. According to some example embodiments, the first initialization signal GI1 and the second initialization signal GI2 may be generated independently of the first gate signal GW1 and the second gate signal GW2. According to some example embodiments, the first initialization signal GI1 and the second initialization signal GI2 may be replaced by the first gate signal GW1 and/or the second gate signal GW2 that is applied to an adjacent gate line (or referred to as an adjacent horizontal line).

As described above, the pixel circuit 100 may sequentially perform the non-light-emitting period (i.e., the initializing period IP and the threshold voltage compensating and data writing period CWP) and the light-emitting period EP in each image frame IF(k), IF(k+1), and IF(k+2). For example, in the initializing period IP, the first initialization transistor IT1, the second initialization transistor IT2, and the bypass transistor BT may be turned on, and thus the initialization voltage VINT (e.g., −4V) may be applied to the first node N1 (i.e., the gate terminal of the driving transistor DT) and the anode of the organic light-emitting element OLED. Thus, the gate terminal of the driving transistor DT and the anode of the organic light-emitting element OLED may be initialized with the initialization voltage VINT.

In the threshold voltage compensating and data writing period CWP, the switching transistor ST, the driving transistor DT, the first compensation transistor CT1, and the second compensation transistor CT2 may be turned on, and thus the data signal DS compensated for the threshold voltage of the driving transistor DT may be stored in the storage capacitor CST. In the light-emitting period EP, the first emission control transistor ET1, the second emission control transistor ET2, and the driving transistor DT may be turned on, and thus the driving current corresponding to the data signal DS stored in the storage capacitor CST may flow into the organic light-emitting element OLED.

Here, because the driving current corresponding to the data signal DS needs to flow only into the organic light-emitting element OLED, the switching transistor ST, the bypass transistor BT, the first compensation transistor CT1, the second compensation transistor CT2, the first initialization transistor IT1, and the second initialization transistor IT2 may be turned off. However, because the fourth node N4 between the first compensation transistor CT1 and the second compensation transistor CT2 becomes or operates in a floating state after the first compensation transistor CT1 and the second compensation transistor CT2 are turned on and then off in the non-light-emitting period IP+CWP, a voltage of the fourth node N4 may increase to a voltage corresponding to the turn-off voltage (e.g., 7.6V) of the first and second gate signals GW1 and GW2 that are applied to the first and second compensation transistors CT1 and CT2 if the fourth node N4 is maintained in the floating state. In addition, because the fifth node N5 between the first initialization transistor IT1 and the second initialization transistor IT2 becomes or operates in a floating state after the first initialization transistor IT1 and the second initialization transistor IT2 are turned on and then off in the non-light-emitting period IP+CWP, a voltage of the fifth node N5 may increase to a voltage corresponding to the turn-off voltage (e.g., 7.6V) of the first and second initialization signals GI1 and GI2 that are applied to the first and second initialization transistors IT1 and IT2 if the fifth node N5 is maintained in the floating state. Thus, a leakage current may flow from the fourth node N4 to the first node N1 through the first compensation transistor CT1 because the voltage of the fourth node N4 is much higher than the voltage of the first node N1. In addition, a leakage current may flow from the fifth node N5 to the first node N1 through the first initialization transistor IT1 because the voltage of the fifth node N5 is much higher than the voltage of the first node N1. That is, the voltage of the first node N1 may be changed (i.e., the voltage of the gate terminal of the driving transistor DT may be changed) when the fourth node N4 between the first compensation transistor CT1 and the second compensation transistor CT2 becomes in the floating state, and thus a flicker that a viewer can recognize may occur because the driving current flowing into the organic light-emitting element OLED is changed. In addition, the voltage of the first node N1 may be changed (i.e., the voltage of the gate terminal of the driving transistor DT may be changed) when the fifth node N5 between the first initialization transistor IT1 and the second initialization transistor IT2 becomes in the floating state, and thus the flicker that the viewer can recognize may occur because the driving current flowing into the organic light-emitting element OLED is changed. When the organic light-emitting display device operates at a relatively high frequency, the image quality deterioration due to the flicker may not be severe because a time during which the leakage current flows is short. On the other hand, when the organic light-emitting display device operates at a relatively low frequency (i.e., in the low-frequency driving mode of the organic light-emitting display device), the image quality deterioration due to the flicker may be relatively more severe because the time during which the leakage current flows is long.

Therefore, the pixel circuit 100 may have a structure in which the first compensation transistor CT1 and the second compensation transistor CT2 are connected in series between the gate terminal of the driving transistor DT (i.e., the first node N1) and one terminal of the driving transistor DT (i.e., the third node N3), where one terminal of the first compensation transistor CT1 is connected to the gate terminal of the driving transistor DT and one terminal of the second compensation transistor CT2 is connected to one terminal of the driving transistor DT. In addition, the pixel circuit 100 may have a structure in which the first initialization transistor IT1 and the second initialization transistor IT2 are connected in series between the gate terminal of the driving transistor DT (i.e., the first node N1) and an initialization voltage line transferring the initialization voltage VINT, where one terminal of the first initialization transistor IT1 is connected to the gate terminal of the driving transistor DT and one terminal of the second initialization transistor IT2 is connected to the initialization voltage line transferring the initialization voltage VINT. Based on the structures, in the low-frequency driving mode of the organic light-emitting display device, the pixel circuit 100 may turn on the first compensation transistor CT1 and the first initialization transistor IT1 during a time (e.g., a set or predetermined time) in N non-light-emitting periods IP+CWP per second (i.e., the driving frequency of the first gate signal GW1 that controls the first compensation transistor CT1 and the driving frequency of the first initialization signal GI1 that controls the first initialization transistor IT1 may be N Hz, which is higher than the driving frequency of the organic light-emitting display device) and may turn on the second compensation transistor CT2 and the second initialization transistor IT2 during a time (e.g., a set or predetermined time) in M non-light-emitting periods IP+CWP per second (i.e., the driving frequency of the second gate signal GW2 that controls the second compensation transistor CT2 and the driving frequency of the second initialization signal GI2 that controls the second initialization transistor IT2 may be M Hz, which is the driving frequency of the organic light-emitting display device). Hence, when the organic light-emitting display device operates in the low-frequency driving mode, in some non-light-emitting periods IP+CWP, the first compensation transistor CT1 may be turned on by the first gate signal GW1, the first initialization transistor IT1 may be turned on by the first initialization signal GI1, and thus the fourth node N4 between the first compensation transistor CT1 and the second compensation transistor CT2 and the fifth node N5 between the first initialization transistor IT1 and the second initialization transistor IT2 may be out of the floating state (i.e., the first node N1 and the fourth node N4 may be electrically connected while the first compensation transistor CT1 is turned on by the first gate signal GW1, and the first node N1 and the fifth node N5 may be electrically connected while the first initialization transistor IT1 is turned on by the first initialization signal GI1). As a result, when the organic light-emitting display device operates in the low-frequency driving mode, in some non-light-emitting periods IP+CWP, the pixel circuit 100 may allow the fourth node N4 between the first compensation transistor CT1 and the second compensation transistor CT2 and the fifth node N5 between the first initialization transistor IT1 and the second initialization transistor IT2 to be out of the floating state and thus may minimize (or reduce) the leakage current flowing into the first node N1 through the first compensation transistor CT1 and the first initialization transistor IT1 to prevent or reduce the flicker that the viewer can recognize or perceive from occurring (i.e., prevent or reduce the voltage of the gate terminal of the driving transistor DT from being changed).

Figure 4:
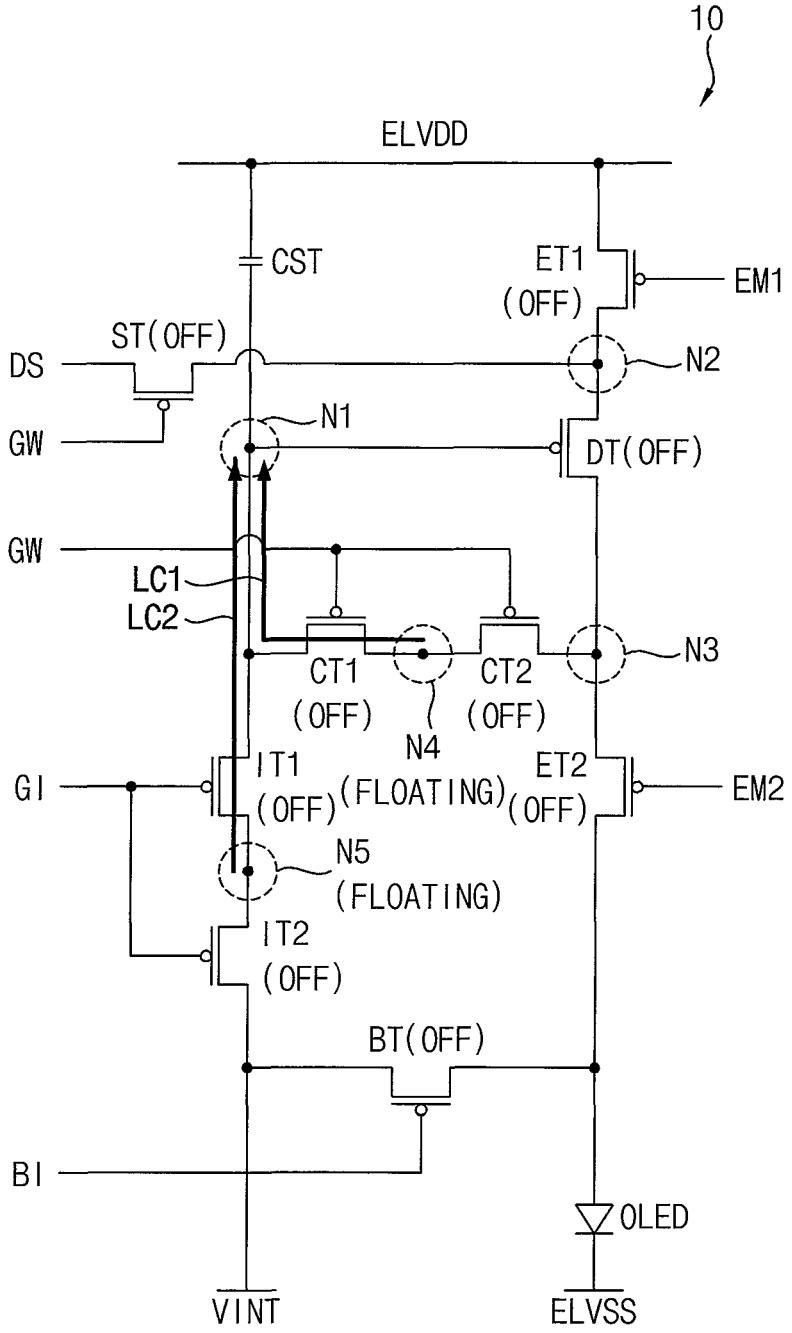
FIG. 4 is a diagram for describing that a leakage current flows as fourth and fifth nodes are floated in a related-art pixel circuit.
Figure 5:
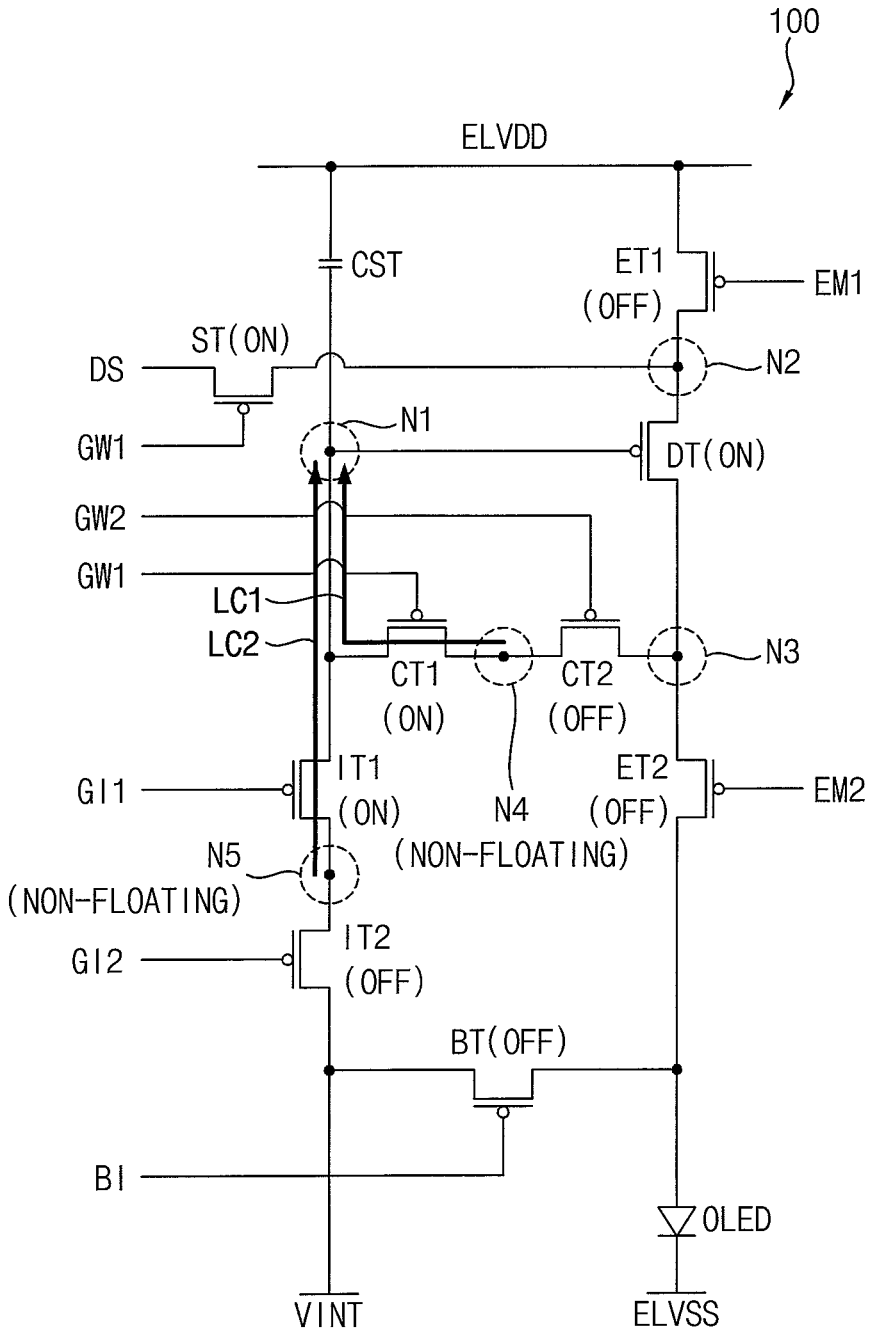
FIG. 5 is a diagram for describing that a leakage current is reduced as fourth and fifth nodes are not floated in the pixel circuit of FIG. 2 according to some example embodiments.

FIG. 4 is a diagram for describing that a leakage current flows as fourth and fifth nodes are floated in a related-art pixel circuit, and FIG. 5 is a diagram for describing that a leakage current is reduced as fourth and fifth nodes are not floated in the pixel circuit of FIG. 2.

Referring to FIGS. 4 and 5, when the organic light-emitting display device operates in the low-frequency driving mode, the pixel circuit 100 may minimize (or reduce) the leakage currents LC1 and LC2 flowing through the first compensation transistor CT1 and the first initialization transistor IT1 in some non-light-emitting periods IP+CWP as compared to a related-art pixel circuit 10. For convenience of description, it is assumed below that the turn-off voltage of the gate signals GW, GW1, and GW2 is 7.6V, the turn-off voltage of the initialization signals GI, GI1, and GI2 is 7.6V, and the initialization voltage VINT is −4V.

As described above, the pixel circuit 100 may minimize (or reduce) the leakage currents LC1 and LC2 flowing through the first compensation transistor CT1 and the first initialization transistor IT1 in some non-light-emitting periods IP+CWP by controlling the first compensation transistor CT1 and the second compensation transistor CT2 with the first gate signal GW1 and the second gate signal GW2 having different driving frequencies, respectively and by controlling the first initialization transistor IT1 and the second initialization transistor IT2 with the first initialization signal GI1 and the second initialization signal GI2 having different driving frequencies, respectively. In the related-art pixel circuit 10 and the pixel circuit 100, during a normal non-light-emitting period IP+CWP in which the initializing operation and the threshold voltage compensating and data writing operation are performed, the first compensation transistor CT1 and the second compensation transistor CT2 may be turned on and then off (i.e., the threshold voltage compensating and data writing operation for storing the data signal DS compensated for the threshold voltage of the driving transistor DT in the storage capacitor CST may be performed) after the first initialization transistor IT1 and the second initialization transistor IT2 are turned on and then off (i.e., the initializing operation for initializing the first node N1 is performed).

As illustrated in FIG. 4, in the related-art pixel circuit 10, during a hold non-light-emitting period IP+CWP in which the initializing operation and the threshold voltage compensating and data writing operation are not performed, the first compensation transistor CT1, the second compensation transistor CT2, the first initialization transistor IT1, and the second initialization transistor IT2 may be turned off. In other words, in the related-art pixel circuit 10, during the hold non-light-emitting period IP+CWP in which the initializing operation and the threshold voltage compensating and data writing operation are not performed, the switching transistor ST, the driving transistor DT, the first compensation transistor CT1, the second compensation transistor CT2, the first emission control transistor ET1, the second emission control transistor ET2, the first initialization transistor IT1, the second initialization transistor IT2, and the bypass transistor BT may be turned off (i.e., indicated by ST(OFF), DT(OFF), CT1(OFF), CT2(OFF), ET1(OFF), ET2(OFF), IT1(OFF), IT2(OFF), and BT(OFF)). Here, because the first compensation transistor CT1 and the second compensation transistor CT2 are turned off, the fourth node N4 between the first compensation transistor CT1 and the second compensation transistor CT2 may become in the floating state (i.e., indicated by N4(FLOATING)). Thus, because the gate signal GW that is applied to the gate terminal of the first compensation transistor CT1 and the gate terminal of the second compensation transistor CT2 has the turn-off voltage of 7.6V, the fourth node N4 between the first compensation transistor CT1 and the second compensation transistor CT2 may have a voltage of about 7.6V due to the influence of the gate signal GW. As a result, because the voltage of the fourth node N4 is 7.6V and the voltage of the first node N1 is a voltage corresponding to the data signal DS (e.g., 0.63V for the (31)th gray-level, −0.03V for the (87)th gray-level, −0.7V for the (255)th gray-level, etc.), the first leakage current LC1 may flow from the fourth node N4 to the first node N1 through the first compensation transistor CT1. Similarly, because the first initialization transistor IT1 and the second initialization transistor IT2 are turned off, the fifth node N5 between the first initialization transistor IT1 and the second initialization transistor IT2 may become in the floating state (i.e., indicated by N5(FLOATING)). Thus, because the initialization signal GI that is applied to the gate terminal of the first initialization transistor IT1 and the gate terminal of the second initialization transistor IT2 has the turn-off voltage of 7.6V, the fifth node N5 between the first initialization transistor IT1 and the second initialization transistor IT2 may have a voltage of about 7.6V due to the influence of the initialization signal GI. As a result, because the voltage of the fifth node N5 is 7.6V and the voltage of the first node N1 is a voltage corresponding to the data signal DS, the second leakage current LC2 may flow from the fifth node N5 to the first node N1 through the first initialization transistor IT1. For example, in the related-art pixel circuit 10, during the hold non-light-emitting period IP+CWP in which the initializing operation and the threshold voltage compensating and data writing operation are not performed, the voltage of the gate terminal of the driving transistor DT (i.e., the first node N1) may be changed due to the leakage currents LC1 and LC2 flowing through the first compensation transistor CT1 and the first initialization transistor IT1, and thus the flicker that the viewer can recognize may occur as light-emitting luminance of the organic light-emitting element OLED is changed.

On the other hand, as illustrated in FIG. 5, in the pixel circuit 100, during the hold non-light-emitting period IP+CWP in which the initializing operation and the threshold voltage compensating and data writing operation are not performed, the second compensation transistor CT2 and the second initialization transistor IT2 may be turned off, but the first compensation transistor CT1 and the first initialization transistor IT1 may be turned on and then off (i.e., the first compensation transistor CT1 may be turned on during a time (e.g., a set or predetermined time), and the first initialization transistor IT1 may be turned on during a time (e.g., a set or predetermined time)). In other words, in the pixel circuit 100, during the hold non-light-emitting period IP+CWP in which the initializing operation and the threshold voltage compensating and data writing operation are not performed, the switching transistor ST, the driving transistor DT, the first compensation transistor CT1, and the first initialization transistor IT1 may be turned on (i.e., indicated by ST(ON), DT(ON), CT1(ON), and IT1(ON)), and the second compensation transistor CT2, the second initialization transistor IT2, the first emission control transistor ET1, the second emission control transistor ET2, and the bypass transistor BT may be turned off (i.e., indicated by CT2(OFF), IT2(OFF), ET1(OFF), ET2(OFF), and BT(OFF)). Here, because the first compensation transistor CT1 and the first initialization transistor IT1 are turned on during a time (e.g., a set or predetermined time), the first node N1 and the fourth node N4 may be electrically connected while the first compensation transistor CT1 is turned on, and the first node N1 and the fifth node N5 may be electrically connected while the first initialization transistor IT1 is turned on. Thus, in the pixel circuit 100, during the hold non-light-emitting period IP+CWP in which the initializing operation and the threshold voltage compensating and data writing operation are not performed, the fourth node N4 between the first compensation transistor CT1 and the second compensation transistor CT2 may be out of the floating state (i.e., indicated by N4(NON-FLOATING)), and the fifth node N5 between the first initialization transistor IT1 and the second initialization transistor IT2 may be out of the floating state (i.e., indicated by N5(NON-FLOATING)). That is, as a voltage difference between the fourth node N4 between the first compensation transistor CT1 and the second compensation transistor CT2 and the first node N1 that is the gate terminal of the driving transistor DT decreases, the first leakage current LC1 may decrease. In addition, as a voltage difference between the fifth node N5 between the first initialization transistor IT1 and the second initialization transistor IT2 and the first node N1 that is the gate terminal of the driving transistor DT decreases, the second leakage current LC2 may decrease. In brief, in the pixel circuit 100, during the hold non-light-emitting period IP+CWP in which the initializing operation and the threshold voltage compensating and data writing operation are not performed, a change in the voltage of the gate terminal of the driving transistor DT may be prevented or reduced, and thus the recognizable flicker due to the leakage currents LC1 and LC2 flowing through the first compensation transistor CT1 and the first initialization transistor IT1 may be prevented (or reduced). Although it is illustrated in FIG. 5 that the first gate signal GW1 is applied to the gate terminal of the switching transistor ST included in the pixel circuit 100, in some example embodiments, the second gate signal GW2 may be applied to the gate terminal of the switching transistor ST included in the pixel circuit 100. In this case, in the pixel circuit 100, during the hold non-light-emitting period IP+CWP in which the initializing operation and the threshold voltage compensating and data writing operation are not performed, the switching transistor ST and the driving transistor DT may be maintained in the turn-off state.

Figure 6:
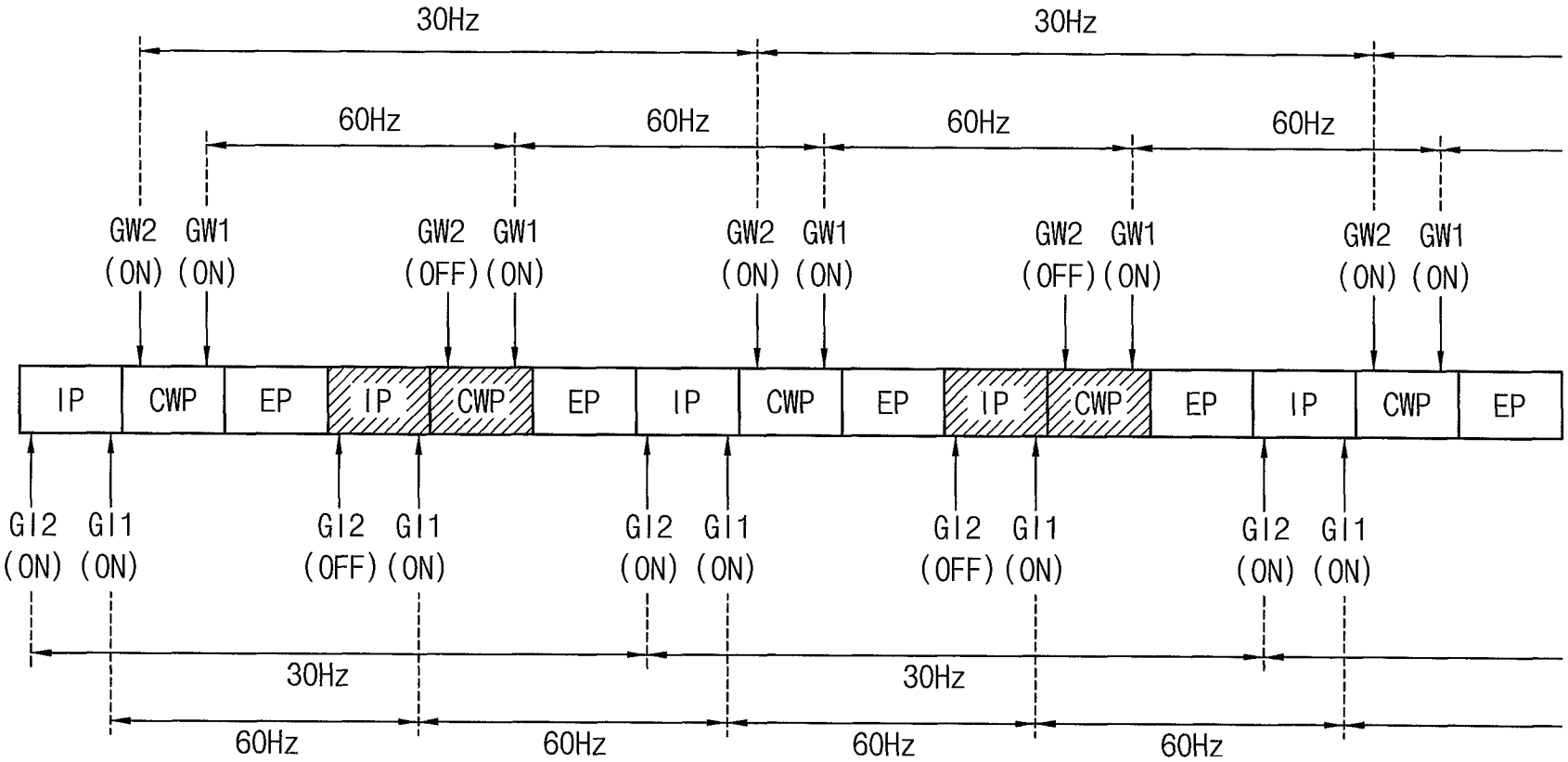
FIG. 6 is a diagram for describing that the pixel circuit of FIG. 2 operates in a low-frequency driving mode according to some example embodiments.

FIG. 6 is a diagram for describing that the pixel circuit of FIG. 2 operates in a low-frequency driving mode, and FIG.

7 is a diagram illustrating an example in which the pixel circuit of FIG. 2 operates in a low-frequency driving mode.

Figure 7:
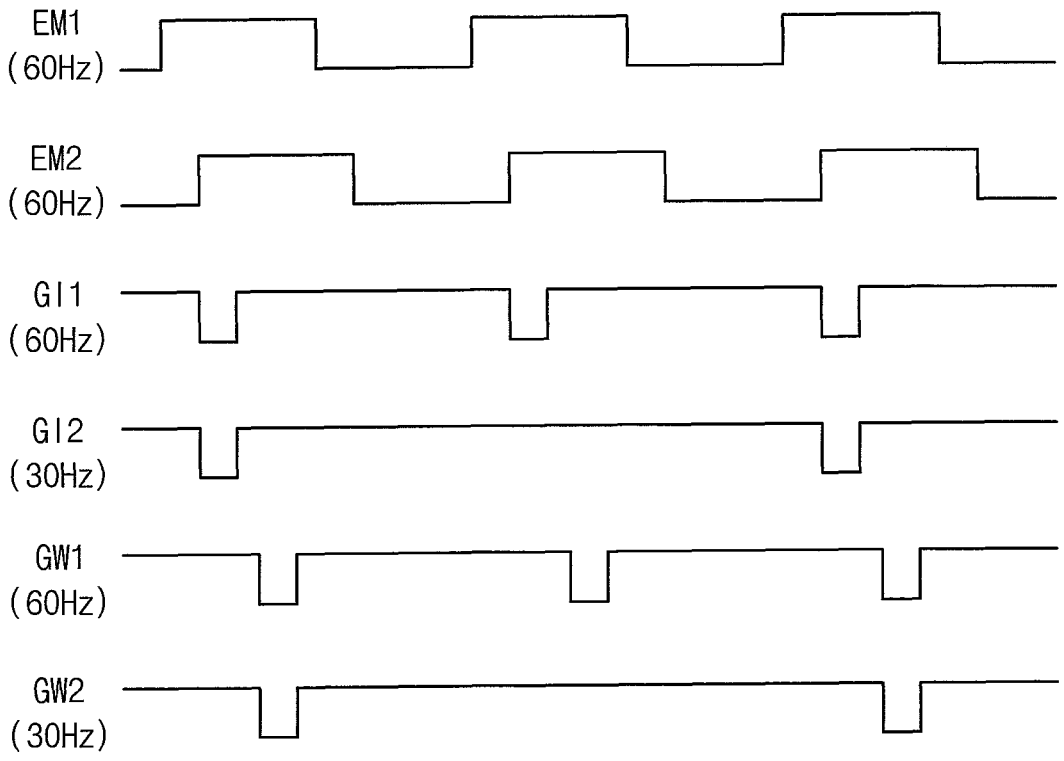
FIG. 7 is a diagram illustrating an example in which the pixel circuit of FIG. 2 operates in a low-frequency driving mode according to some example embodiments.

Referring to FIGS. 6 and 7, in the low-frequency driving mode of the organic light-emitting display device, the pixel circuit 100 may sequentially perform the initializing period IP, the threshold voltage compensating and data writing period CWP, and the light-emitting period EP in each image frame. As described above, in the low-frequency driving mode of the organic light-emitting display device, the driving frequency of the first gate signal GW1 may be N Hz, which is higher than the driving frequency of the organic light-emitting display device, the driving frequency of the second gate signal GW2 may be M Hz, which is the driving frequency of the organic light-emitting display device, the driving frequency of the first initialization signal GI1 may be N Hz, which is higher than the driving frequency of the organic light-emitting display device, and the driving frequency of the second initialization signal GI2 may be M Hz, which is the driving frequency of the organic light-emitting display device. In example embodiments, the driving frequency of the first emission control signal EM1 and the driving frequency of the second emission control signal EM2 may be equal to the driving frequency of the first gate signal GW1 (i.e., N Hz, which is higher than the driving frequency of the organic light-emitting display device). Thus, the first compensation transistor CT1 that is controlled by the first gate signal GW1 may be turned on during a time (e.g., a set or predetermined time) in N non-light-emitting periods IP+CWP per second, the second compensation transistor CT2 that is controlled by the second gate signal GW2 may be turned on during a time (e.g., a set or predetermined time) in M non-light-emitting periods IP+CWP per second, the first initialization transistor IT1 that is controlled by the first initialization signal GI1 may be turned on during a time (e.g., a set or predetermined time) in N non-light-emitting periods IP+CWP per second, and the second initialization transistor IT2 that is controlled by the second initialization signal GI2 may be turned on during a time (e.g., a set or predetermined time) in M non-light-emitting periods IP+CWP per second. For convenience of description, it is assumed below that the driving frequency of the organic light-emitting display device is 30 Hz, the driving frequency of the first gate signal GW1 is 60 Hz, the driving frequency of the second gate signal GW2 is 30 Hz, the driving frequency of the first initialization signal GI1 is 60 Hz, the driving frequency of the second initialization signal GI2 is 30 Hz, the first compensation transistor CT1 that is controlled by the first gate signal GW1 is turned on during a time (e.g., a set or predetermined time) in 60 non-light-emitting periods IP+CWP per second, the second compensation transistor CT2 that is controlled by the second gate signal GW2 is turned on during a time (e.g., a set or predetermined time) in 30 non-light-emitting periods IP+CWP per second, the first initialization transistor IT1 that is controlled by the first initialization signal GI1 is turned on during a time (e.g., a set or predetermined time) in 60 non-light-emitting periods IP+CWP per second, and the second initialization transistor IT2 that is controlled by the second initialization signal GI2 is turned on during a time (e.g., a set or predetermined time) in 30 non-light-emitting periods IP+CWP per second.

In the non-light-emitting period IP+CWP of the first image frame (i.e., the normal non-light-emitting period in which the initializing operation and the threshold voltage compensating and data writing operation are performed), the first gate signal GW1 and the second gate signal GW2 may have the turn-on voltage level during a time (e.g., a set or predetermined time), and the first initialization signal GI1 and the second initialization signal GI2 may have the turn-on voltage level during a time (e.g., a set or predetermined time) (i.e., indicated by GW1(ON), GW2(ON), GI1(ON), and GI2(ON)). For example, as illustrated in FIGS. 2 and 7, in the non-light-emitting period IP+CWP of the first image frame, the first emission control transistor ET1 and the second emission control transistor ET2 may be turned off by the first emission control signal EM1 and the second emission control signal EM2. Here, in the initializing period IP of the first image frame, the first initialization transistor IT1 and the second initialization transistor IT2 may be turned on and then off by the first initialization signal GI1 and the second initialization signal GI2. Then, in the threshold voltage compensating and data writing period CWP of the first image frame, the first compensation transistor CT1 and the second compensation transistor CT2 may be turned on and then off by the first gate signal GW1 and the second gate signal GW2. Subsequently, in the light-emitting period EP of the first image frame, the first emission control transistor ET1 and the second emission control transistor ET2 may be turned on by the first emission control signal EM1 and the second emission control signal EM2. Next, in the non-light-emitting period IP+CWP of the second image frame following the first image frame (i.e., the hold non-light-emitting period in which the initializing operation and the threshold voltage compensating and data writing operation are not performed), the second gate signal GW2 and the second initialization signal GI2 may have the turn-off voltage level, and the first gate signal GW1 and the first initialization signal GI1 may have the turn-on voltage level during a time (e.g., a set or predetermined time) (i.e., indicated by GW1(ON), GW2(OFF), GI1(ON), and GI2(OFF)). For example, as illustrated in FIGS. 2 and 7, in the non-light-emitting period IP+CWP of the second image frame, the first emission control transistor ET1 and the second emission control transistor ET2 may be turned off by the first emission control signal EM1 and the second emission control signal EM2. In the initializing period IP of the second image frame, the second initialization transistor IT2 may be maintained in the turn-off state by the second initialization signal GI2. In the threshold voltage compensating and data writing period CWP of the second image frame, the second compensation transistor CT2 may be maintained in the turn-off state by the second gate signal GW2. However, in the initializing period IP of the second image frame, the first initialization transistor IT1 may be turned on and then off by the first initialization signal GI1 (i.e., the first node N1 and the fifth node N5 are electrically connected). In the threshold voltage compensating and data writing period CWP of the second image frame, the first compensation transistor CT1 may be turned on and then off by the first gate signal GW1 (i.e., the first node N1 and the fourth node N4 are electrically connected). As a result, as described with reference to FIG. 5, in the non-light-emitting period IP+CWP of the second image frame, the leakage currents LC1 and LC2 flowing through the first compensation transistor CT1 and the first initialization transistor IT1 may be reduced.

Next, in the non-light-emitting period IP+CWP of the third image frame following the second image frame (i.e., the normal non-light-emitting period in which the initializing operation and the threshold voltage compensating and data writing operation are performed), the first gate signal GW1 and the second gate signal GW2 may have the turn-on voltage level during a time (e.g., a set or predetermined time), and the first initialization signal GI1 and the second initialization signal GI2 may have the turn-on voltage level during a time (e.g., a set or predetermined time) (i.e., indicated by GW1(ON), GW2(ON), GI1(ON), and GI2 (ON)). For example, as illustrated in FIGS. 2 and 7, in the non-light-emitting period IP+CWP of the third image frame, the first emission control transistor ET1 and the second emission control transistor ET2 may be turned off by the first emission control signal EM1 and the second emission control signal EM2. In the initializing period IP of the third image frame, the first initialization transistor IT1 and the second initialization transistor IT2 may be turned on and then off by the first initialization signal GI1 and the second initialization signal GI2. Then, in the threshold voltage compensating and data writing period CWP of the third image frame, the first compensation transistor CT1 and the second compensation transistor CT2 may be turned on and then off by the first gate signal GW1 and the second gate signal GW2. Subsequently, in the light-emitting period EP of the third image frame, the first emission control transistor ET1 and the second emission control transistor ET2 may be turned on by the first emission control signal EM1 and the second emission control signal EM2. Next, in the non-light-emitting period IP+CWP of the fourth image frame following the third image frame (i.e., the hold non-light-emitting period in which the initializing operation and the threshold voltage compensating and data writing operation are not performed), the second gate signal GW2 and the second initialization signal GI2 may have the turn-off voltage level, and the first gate signal GW1 and the first initialization signal GI1 may have the turn-on voltage level during a time (e.g., a set or predetermined time) (i.e., indicated by GW1 (ON), GW2(OFF), GI1(ON), and GI2(OFF)). For example, as illustrated in FIGS. 2 and 7, in the non-light-emitting period IP+CWP of the fourth image frame, the first emission control transistor ET1 and the second emission control transistor ET2 may be turned off by the first emission control signal EM1 and the second emission control signal EM2. In the initializing period IP of the fourth image frame, the second initialization transistor IT2 may be maintained in the turn-off state by the second initialization signal GI2. In the threshold voltage compensating and data writing period CWP of the fourth image frame, the second compensation transistor CT2 may be maintained in the turn-off state by the second gate signal GW2. However, in the initializing period IP of the fourth image frame, the first initialization transistor IT1 may be turned on and then off by the first initialization signal GI1 (i.e., the first node N1 and the fifth node N5 are electrically connected). In the threshold voltage compensating and data writing period CWP of the fourth image frame, the first compensation transistor CT1 may be turned on and then off by the first gate signal GW1 (i.e., the first node N1 and the fourth node N4 are electrically connected). As a result, as described with reference to FIG. 5, in the non-light-emitting period IP+CWP of the fourth image frame, the leakage currents LC1 and LC2 flowing through the first compensation transistor CT1 and the first initialization transistor IT1 may be reduced.

In this manner, the first compensation transistor CT1 may be turned on during a time (e.g., a set or predetermined time) in 60 non-light-emitting periods IP+CWP per second, the second compensation transistor CT2 may be turned on during a time (e.g., a set or predetermined time) in 30 non-light-emitting periods IP+CWP per second, the first initialization transistor IT1 may be turned on during a time (e.g., a set or predetermined time) in 60 non-light-emitting periods IP+CWP per second, and the second initialization transistor IT2 may be turned on during a time (e.g., a set or predetermined time) in 30 non-light-emitting periods IP+CWP per second. To this end, the first gate signal GW1 that controls the first compensation transistor CT1 may be generated to have the driving frequency of 60 Hz (i.e., indicated by 60 Hz), which is higher than the driving frequency of the organic light-emitting display device, the second gate signal GW2 that controls the second compensation transistor CT2 may be generated to have the driving frequency of 30 Hz (i.e., indicated by 30 Hz), which is the driving frequency of the organic light-emitting display device, the first initialization signal GI1 that controls the first initialization transistor IT1 may be generated to have the driving frequency of 60 Hz (i.e., indicated by 60 Hz), which is higher than the driving frequency of the organic light-emitting display device, and the second initialization signal GI2 that controls the second initialization transistor IT2 may be generated to have the driving frequency of 30 Hz (i.e., indicated by 30 Hz), which is the driving frequency of the organic light-emitting display device. Here, because the first gate signal GW1 that controls the first compensation transistor CT1 and the second gate signal GW2 that controls the second compensation transistor CT2 have different driving frequencies, the first gate signal GW1 and the second gate signal GW2 may be generated by respective signal generating circuits that are independent of each other. Similarly, because the first initialization signal GI1 that controls the first initialization transistor IT1 and the second initialization signal GI2 that controls the second initialization transistor IT2 have different driving frequencies, the first initialization signal GI1 and the second initialization signal GI2 may be generated by respective signal generating circuits that are independent of each other. Although it is described above that the driving frequency of the organic light-emitting display device is 30 Hz (i.e., the low-frequency driving mode of the organic light-emitting display device), the driving frequency of the first gate signal GW1 is 60 Hz, the driving frequency of the second gate signal GW2 is 30 Hz, the driving frequency of the first initialization signal GI1 is 60 Hz, and the driving frequency of the second initialization signal GI2 is 30 Hz, the present inventive concept is not limited thereto. For example, it should be understood that the driving frequency of the first gate signal GW1, the driving frequency of the second gate signal GW2, the driving frequency of the first initialization signal GI1, and the driving frequency of the second initialization signal GI2 may be variously set according to the driving frequency of the organic light-emitting display device.

Figure 8:
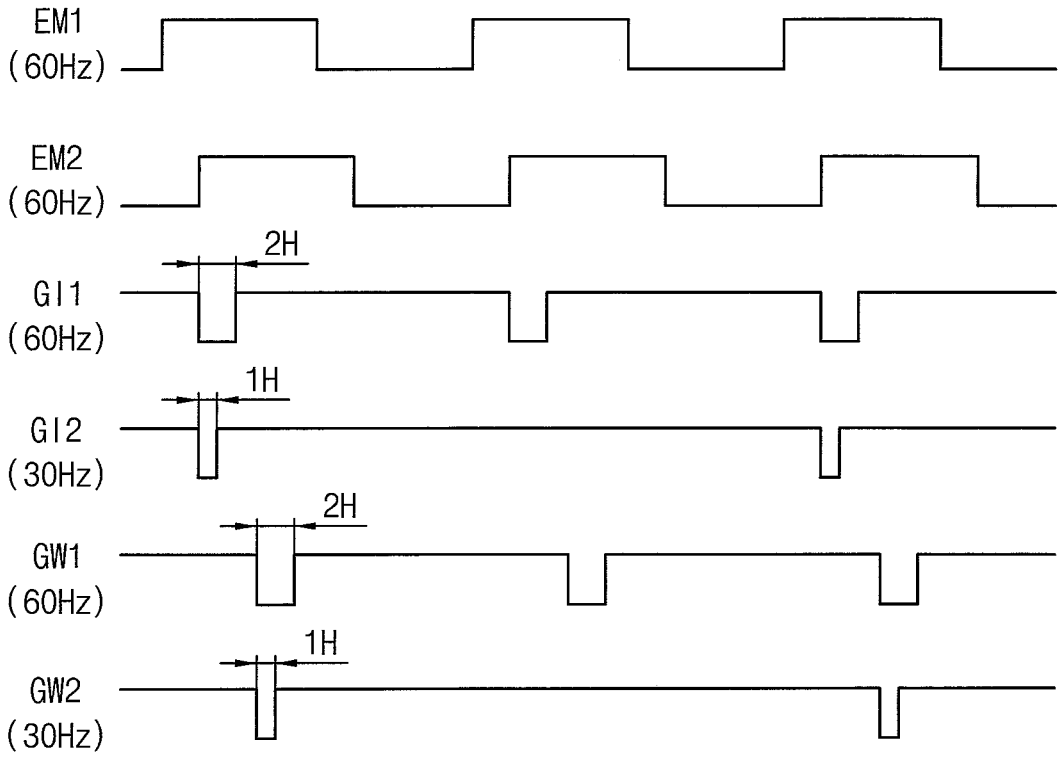
FIG. 8 is a diagram illustrating an example in which the pixel circuit of FIG. 2 operates in a low-frequency driving mode according to some example embodiments.

FIG. 8 is a diagram illustrating further details of an example in which the pixel circuit of FIG. 2 operates in a low-frequency driving mode according to some example embodiments.

Referring to FIG. 8, in the low-frequency driving mode of the organic light-emitting display device, the driving frequency of the first gate signal GW1 may be N Hz (e.g., 60 Hz), which is higher than the driving frequency of the organic light-emitting display device, the driving frequency of the second gate signal GW2 may be M Hz (e.g., 30 Hz), which is the driving frequency of the organic light-emitting display device, the driving frequency of the first initialization signal GI1 may be N Hz (e.g., 60 Hz), which is higher than the driving frequency of the organic light-emitting display device, and the driving frequency of the second initialization signal GI2 may be M Hz (e.g., 30 Hz), which is the driving frequency of the organic light-emitting display device. In example embodiments, the driving frequency of the first emission control signal EM1 and the driving frequency of the second emission control signal EM2 may be N Hz (e.g., 60 Hz), which is higher than the driving frequency of the organic light-emitting display device. As illustrated in FIG. 8, the first compensation transistor CT1 that is controlled by the first gate signal GW1 may be turned on during a first time (e.g., two horizontal periods 2H) in N non-light-emitting periods IP+CWP per second, the second compensation transistor CT2 that is controlled by the second gate signal GW2 may be turned on during a second time (e.g., one horizontal period 1H) in M non-light-emitting periods IP+CWP per second, the first initialization transistor IT1 that is controlled by the first initialization signal GI1 may be turned on during the first time (e.g., two horizontal periods 2H) in N non-light-emitting periods IP+CWP per second, and the second initialization transistor IT2 that is controlled by the second initialization signal GI2 may be turned on during the second time (e.g., one horizontal period 1H) in M non-light-emitting periods IP+CWP per second. That is, the turn-on voltage level period of the first gate signal GW1 may be longer than the turn-on voltage level period of the second gate signal GW2, and the turn-on voltage level period of the second gate signal GW2 may overlap the turn-on voltage level period of the first gate signal GW1. In addition, the turn-on voltage level period of the first initialization signal GI1 may be longer than the turn-on voltage level period of the second initialization signal GI2, and the turn-on voltage level period of the second initialization signal GI2 may overlap the turn-on voltage level period of the first initialization signal GI1. According to some example embodiments, as illustrated in FIG. 8, a start point of the turn-on voltage level period of the second gate signal GW2 may be consistent with a start point of the turn-on voltage level period of the first gate signal GW1, an end point of the turn-on voltage level period of the second gate signal GW2 may be before (or prior to) an end point of the turn-on voltage level period of the first gate signal GW1, a start point of the turn-on voltage level period of the second initialization signal GI2 may be consistent with a start point of the turn-on voltage level period of the first initialization signal GI1, and an end point of the turn-on voltage level period of the second initialization signal GI2 may be before an end point of the turn-on voltage level period of the first initialization signal GI1. Thus, because a period where the turn-on voltage level period of the first gate signal GW1 and the turn-on voltage level period of the second gate signal GW2 do not overlap exists in the normal non-light-emitting period IP+CWP of an image frame, the fourth node N4 between the first compensation transistor CT1 and the second compensation transistor CT2 may be out of the floating state in the period where the turn-on voltage level period of the first gate signal GW1 and the turn-on voltage level period of the second gate signal GW2 do not overlap. In the hold non-light-emitting period IP+CWP of the image frame, the first compensation transistor CT1 may be turned on during the first time, and thus the fourth node N4 between the first compensation transistor CT1 and the second compensation transistor CT2 may be out of the floating state. As a result, the first leakage current LC1 flowing from the fourth node N4 to the first node N1 through the first compensation transistor CT1 may be reduced. Similarly, because a period where the turn-on voltage level period of the first initialization signal GI1 and the turn-on voltage level period of the second initialization signal GI2 do not overlap exists in the normal non-light-emitting period IP+CWP of an image frame, the fifth node N5 between the first initialization transistor IT1 and the second initialization transistor IT2 may be out of the floating state in the period where the turn-on voltage level period of the first initialization signal GI1 and the turn-on voltage level period of the second initialization signal GI2 do not overlap. In the hold non-light-emitting period IP+CWP of the image frame, the first initialization transistor IT1 may be turned on during the first time, and thus the fifth node N5 between the first initialization transistor IT1 and the second initialization transistor IT2 may be out of the floating state. As a result, the second leakage current LC2 flowing from the fifth node N5 to the first node N1 through the first initialization transistor IT1 may be reduced.

Figure 9:
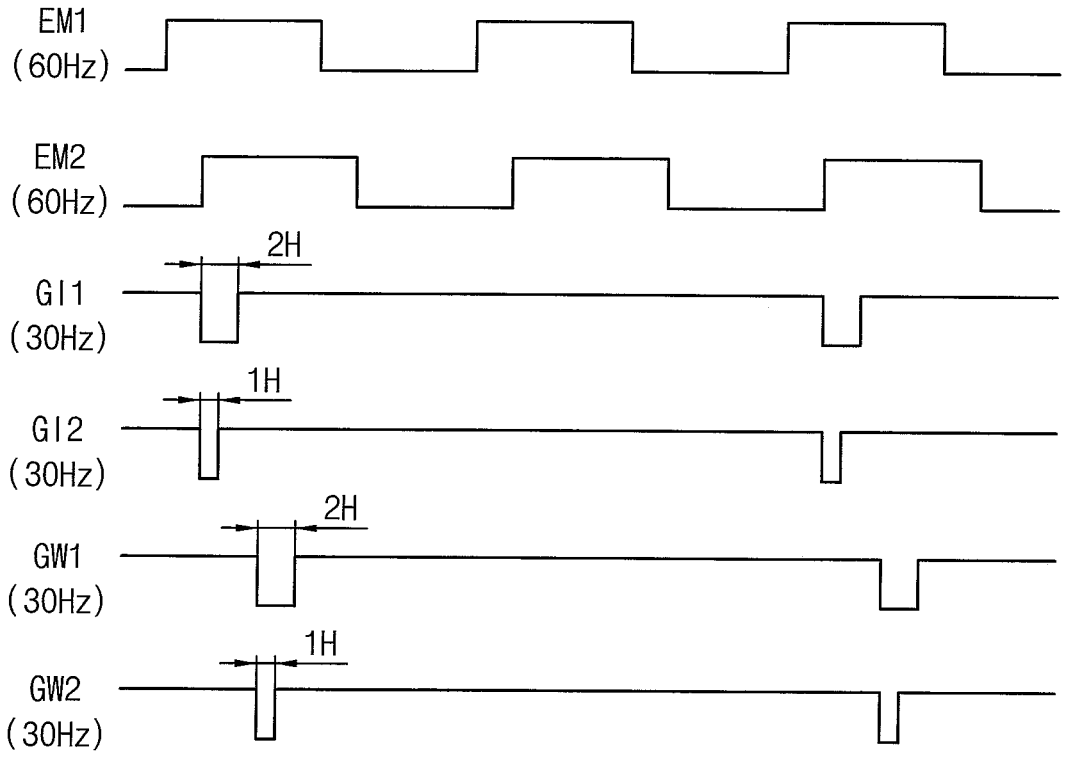
FIG. 9 is a diagram illustrating further details of an example in which the pixel circuit of FIG. 2 operates in a low-frequency driving mode according to some example embodiments.

FIG. 9 is a diagram illustrating further details of an example in which the pixel circuit of FIG. 2 operates in a low-frequency driving mode according to some example embodiments.

Referring to FIG. 9, in the low-frequency driving mode of the organic light-emitting display device, the driving frequency of the first gate signal GW1 may be M Hz (e.g., 30 Hz), which is the driving frequency of the organic light-emitting display device, the driving frequency of the second gate signal GW2 may be M Hz (e.g., 30 Hz), which is the driving frequency of the organic light-emitting display device, the driving frequency of the first initialization signal GI1 may be M Hz (e.g., 30 Hz), which is the driving frequency of the organic light-emitting display device, and the driving frequency of the second initialization signal GI2 may be M Hz (e.g., 30 Hz), which is the driving frequency of the organic light-emitting display device. In example embodiments, the driving frequency of the first emission control signal EM1 and the driving frequency of the second emission control signal EM2 may be N Hz (e.g., 60 Hz), which is higher than the driving frequency of the organic light-emitting display device. In this case, in the hold non-light-emitting period IP+CWP of the image frame, because the first compensation transistor CT1 that is controlled by the first gate signal GW1, the second compensation transistor CT2 that is controlled by the second gate signal GW2, the first initialization transistor IT1 that is controlled by the first initialization signal GI1, and the second initialization transistor IT2 that is controlled by the second initialization signal GI2 are turned off, the first leakage current LC1 flowing from the fourth node N4 to the first node N1 through the first compensation transistor CT1 and the second leakage current LC2 flowing from the fifth node N5 to the first node N1 through the first initialization transistor IT1 may be large. As illustrated in FIG. 9, the first compensation transistor CT1 that is controlled by the first gate signal GW1 may be turned on during a first time (e.g., two horizontal periods 2H) in M non-light-emitting periods IP+CWP per second, the second compensation transistor CT2 that is controlled by the second gate signal GW2 may be turned on during a second time (e.g., one horizontal period 1H) in M non-light-emitting periods IP+CWP per second, the first initialization transistor IT1 that is controlled by the first initialization signal GI1 may be turned on during the first time (e.g., two horizontal periods 2H) in M non-light-emitting periods IP+CWP per second, and the second initialization transistor IT2 that is controlled by the second initialization signal GI2 may be turned on during the second time (e.g., one horizontal period 1H) in M non-light-emitting periods IP+CWP per second. That is, the turn-on voltage level period of the first gate signal GW1 may be longer than the turn-on voltage level period of the second gate signal GW2, and the turn-on voltage level period of the second gate signal GW2 may overlap the turn-on voltage level period of the first gate signal GW1. In addition, the turn-on voltage level period of the first initialization signal GI1 may be longer than the turn-on voltage level period of the second initialization signal GI2, and the turn-on voltage level period of the second initialization signal GI2 may overlap the turn-on voltage level period of the first initialization signal GI1. According to some example embodiments, as illustrated in FIG. 9, a start point of the turn-on voltage level period of the second gate signal GW2 may be consistent with a start point of the turn-on voltage level period of the first gate signal GW1, an end point of the turn-on voltage level period of the second gate signal GW2 may be before an end point of the turn-on voltage level period of the first gate signal GW1, a start point of the turn-on voltage level period of the second initialization signal GI2 may be consistent with a start point of the turn-on voltage level period of the first initialization signal GI1, and an end point of the turn-on voltage level period of the second initialization signal GI2 may be before an end point of the turn-on voltage level period of the first initialization signal GI1. Thus, because a period where the turn-on voltage level period of the first gate signal GW1 and the turn-on voltage level period of the second gate signal GW2 do not overlap exists in the normal non-light-emitting period IP+CWP of an image frame, the fourth node N4 between the first compensation transistor CT1 and the second compensation transistor CT2 may be out of the floating state in the period where the turn-on voltage level period of the first gate signal GW1 and the turn-on voltage level period of the second gate signal GW2 do not overlap. As a result, the first leakage current LC1 flowing from the fourth node N4 to the first node N1 through the first compensation transistor CT1 may be reduced. Similarly, because a period where the turn-on voltage level period of the first initialization signal GI1 and the turn-on voltage level period of the second initialization signal GI2 do not overlap exists in the normal non-light-emitting period IP+CWP of an image frame, the fifth node N5 between the first initialization transistor IT1 and the second initialization transistor IT2 may be out of the floating state in the period where the turn-on voltage level period of the first initialization signal GI1 and the turn-on voltage level period of the second initialization signal GI2 do not overlap. As a result, the second leakage current LC2 flowing from the fifth node N5 to the first node N1 through the first initialization transistor IT1 may be reduced.

Figure 10:
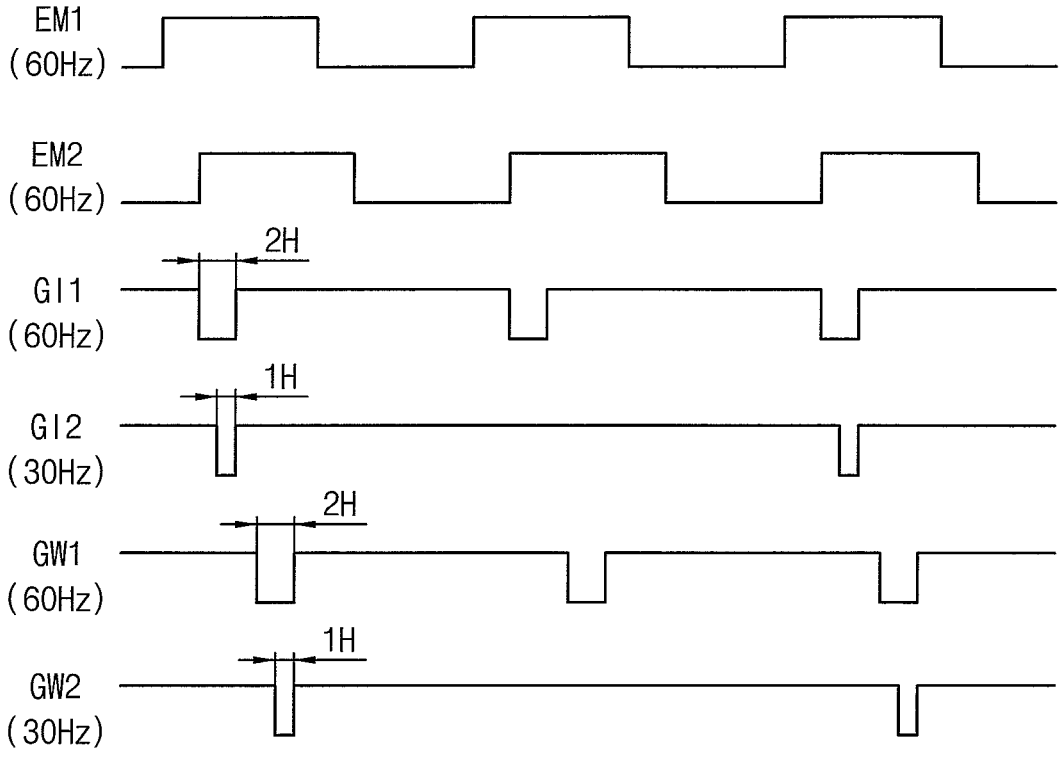
FIG. 10 is a diagram illustrating further details of an example in which the pixel circuit of FIG. 2 operates in a low-frequency driving mode according to some example embodiments.

FIG. 10 is a diagram illustrating further details of an example in which the pixel circuit of FIG. 2 operates in a low-frequency driving mode according to some example embodiments.

Referring to FIG. 10, in the low-frequency driving mode of the organic light-emitting display device, the driving frequency of the first gate signal GW1 may be N Hz (e.g., 60 Hz), which is higher than the driving frequency of the organic light-emitting display device, the driving frequency of the second gate signal GW2 may be M Hz (e.g., 30 Hz), which is the driving frequency of the organic light-emitting display device, the driving frequency of the first initialization signal GI1 may be N Hz (e.g., 60 Hz), which is higher than the driving frequency of the organic light-emitting display device, and the driving frequency of the second initialization signal GI2 may be M Hz (e.g., 30 Hz), which is the driving frequency of the organic light-emitting display device. In example embodiments, the driving frequency of the first emission control signal EM1 and the driving frequency of the second emission control signal EM2 may be N Hz (e.g., 60 Hz), which is higher than the driving frequency of the organic light-emitting display device. As illustrated in FIG. 10, the first compensation transistor CT1 that is controlled by the first gate signal GW1 may be turned on during a first time (e.g., two horizontal periods 2H) in N non-light-emitting periods IP+CWP per second, the second compensation transistor CT2 that is controlled by the second gate signal GW2 may be turned on during a second time (e.g., one horizontal period 1H) in M non-light-emitting periods IP+CWP per second, the first initialization transistor IT1 that is controlled by the first initialization signal GI1 may be turned on during the first time (e.g., two horizontal periods 2H) in N non-light-emitting periods IP+CWP per second, and the second initialization transistor IT2 that is controlled by the second initialization signal GI2 may be turned on during the second time (e.g., one horizontal period 1H) in M non-light-emitting periods IP+CWP per second. That is, the turn-on voltage level period of the first gate signal GW1 may be longer than the turn-on voltage level period of the second gate signal GW2, and the turn-on voltage level period of the second gate signal GW2 may overlap the turn-on voltage level period of the first gate signal GW1. In addition, the turn-on voltage level period of the first initialization signal GI1 may be longer than the turn-on voltage level period of the second initialization signal GI2, and the turn-on voltage level period of the second initialization signal GI2 may overlap the turn-on voltage level period of the first initialization signal GI1. According to some example embodiments, as illustrated in FIG. 10, a start point of the turn-on voltage level period of the second gate signal GW2 may be after a start point of the turn-on voltage level period of the first gate signal GW1, an end point of the turn-on voltage level period of the second gate signal GW2 may be consistent with an end point of the turn-on voltage level period of the first gate signal GW1, a start point of the turn-on voltage level period of the second initialization signal GI2 may be after a start point of the turn-on voltage level period of the first initialization signal GI1, and an end point of the turn-on voltage level period of the second initialization signal GI2 may be consistent with an end point of the turn-on voltage level period of the first initialization signal GI1. Thus, because a period where the turn-on voltage level period of the first gate signal GW1 and the turn-on voltage level period of the second gate signal GW2 do not overlap exists in the normal non-light-emitting period IP+CWP of an image frame, the fourth node N4 between the first compensation transistor CT1 and the second compensation transistor CT2 may be out of the floating state in the period where the turn-on voltage level period of the first gate signal GW1 and the turn-on voltage level period of the second gate signal GW2 do not overlap. In the hold non-light-emitting period IP+CWP of the image frame, the first compensation transistor CT1 may be turned on during the first time, and thus the fourth node N4 between the first compensation transistor CT1 and the second compensation transistor CT2 may be out of the floating state. As a result, the first leakage current LC1 flowing from the fourth node N4 to the first node N1 through the first compensation transistor CT1 may be reduced. Similarly, because a period where the turn-on voltage level period of the first initialization signal GI1 and the turn-on voltage level period of the second initialization signal GI2 do not overlap exists in the normal non-light-emitting period IP+CWP of an image frame, the fifth node N5 between the first initialization transistor IT1 and the second initialization transistor IT2 may be out of the floating state in the period where the turn-on voltage level period of the first initialization signal GI1 and the turn-on voltage level period of the second initialization signal GI2 do not overlap. In the hold non-light-emitting period IP+CWP of the image frame, the first initialization transistor IT1 may be turned on during the first time, and thus the fifth node N5 between the first initialization transistor IT1 and the second initialization transistor IT2 may be out of the floating state. As a result, the second leakage current LC2 flowing from the fifth node N5 to the first node N1 through the first initialization transistor IT1 may be reduced. In some example embodiments, the start point of the turn-on voltage level period of the second gate signal GW2 may be after the start point of the turn-on voltage level period of the first gate signal GW1, and the end point of the turn-on voltage level period of the second gate signal GW2 may be before the end point of the turn-on voltage level period of the first gate signal GW1.

Figure 11:
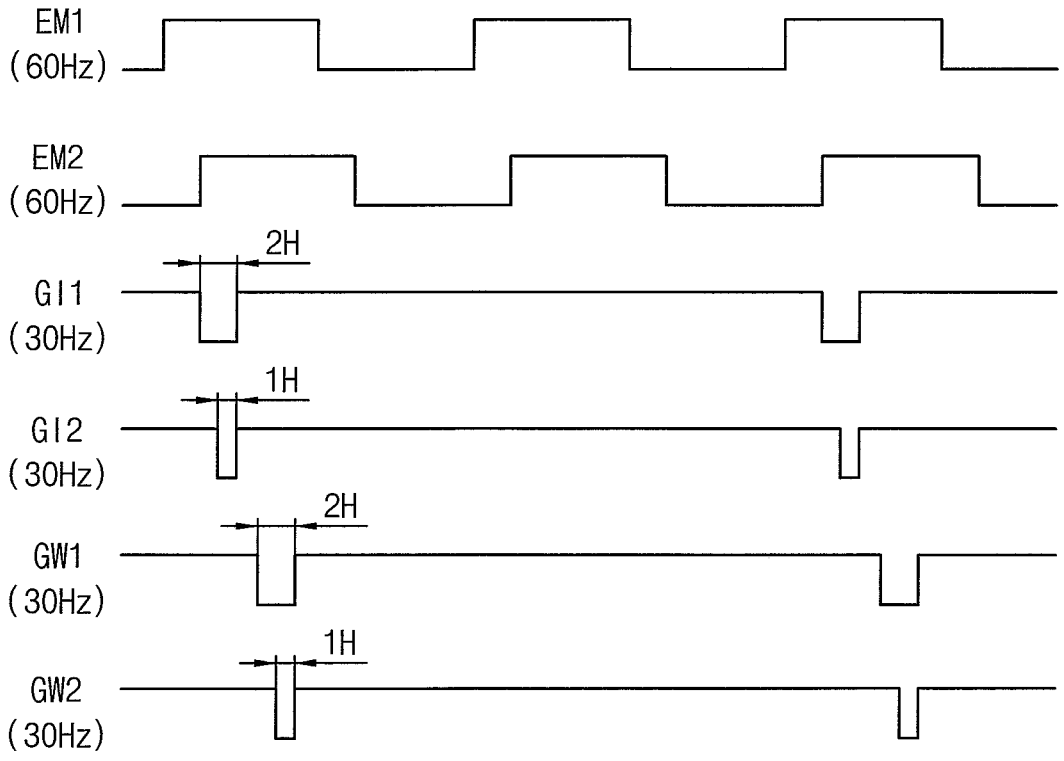
FIG. 11 is a diagram illustrating further details of an example in which the pixel circuit of FIG. 2 operates in a low-frequency driving mode according to some example embodiments.

FIG. 11 is a diagram illustrating further details of an example in which the pixel circuit of FIG. 2 operates in a low-frequency driving mode according to some example embodiments.

Referring to FIG. 11, in the low-frequency driving mode of the organic light-emitting display device, the driving frequency of the first gate signal GW1 may be M Hz (e.g., 30 Hz), which is the driving frequency of the organic light-emitting display device, the driving frequency of the second gate signal GW2 may be M Hz (e.g., 30 Hz), which is the driving frequency of the organic light-emitting display device, the driving frequency of the first initialization signal GI1 may be M Hz (e.g., 30 Hz), which is the driving frequency of the organic light-emitting display device, and the driving frequency of the second initialization signal GI2 may be M Hz (e.g., 30 Hz), which is the driving frequency of the organic light-emitting display device. In example embodiments, the driving frequency of the first emission control signal EM1 and the driving frequency of the second emission control signal EM2 may be N Hz (e.g., 60 Hz), which is higher than the driving frequency of the organic light-emitting display device. In this case, in the hold non-light-emitting period IP+CWP of the image frame, because the first compensation transistor CT1 that is controlled by the first gate signal GW1, the second compensation transistor CT2 that is controlled by the second gate signal GW2, the first initialization transistor IT1 that is controlled by the first initialization signal GI1, and the second initialization transistor IT2 that is controlled by the second initialization signal GI2 are turned off, the first leakage current LC1 flowing from the fourth node N4 to the first node N1 through the first compensation transistor CT1 and the second leakage current LC2 flowing from the fifth node N5 to the first node N1 through the first initialization transistor IT1 may be large. As illustrated in FIG. 11, the first compensation transistor CT1 that is controlled by the first gate signal GW1 may be turned on during a first time (e.g., two horizontal periods 2H) in M non-light-emitting periods IP+CWP per second, the second compensation transistor CT2 that is controlled by the second gate signal GW2 may be turned on during a second time (e.g., one horizontal period 1H) in M non-light-emitting periods IP+CWP per second, the first initialization transistor IT1 that is controlled by the first initialization signal GI1 may be turned on during the first time (e.g., two horizontal periods 2H) in M non-light-emitting periods IP+CWP per second, and the second initialization transistor IT2 that is controlled by the second initialization signal GI2 may be turned on during the second time (e.g., one horizontal period 1H) in M non-light-emitting periods IP+CWP per second. That is, the turn-on voltage level period of the first gate signal GW1 may be longer than the turn-on voltage level period of the second gate signal GW2, and the turn-on voltage level period of the second gate signal GW2 may overlap the turn-on voltage level period of the first gate signal GW1. In addition, the turn-on voltage level period of the first initialization signal GI1 may be longer than the turn-on voltage level period of the second initialization signal GI2, and the turn-on voltage level period of the second initialization signal GI2 may overlap the turn-on voltage level period of the first initialization signal GI1. According to some example embodiments, as illustrated in FIG. 11, a start point of the turn-on voltage level period of the second gate signal GW2 may be after a start point of the turn-on voltage level period of the first gate signal GW1, an end point of the turn-on voltage level period of the second gate signal GW2 may be consistent with an end point of the turn-on voltage level period of the first gate signal GW1, a start point of the turn-on voltage level period of the second initialization signal GI2 may be after a start point of the turn-on voltage level period of the first initialization signal GI1, and an end point of the turn-on voltage level period of the second initialization signal GI2 may be consistent with an end point of the turn-on voltage level period of the first initialization signal GI1. Thus, because a period where the turn-on voltage level period of the first gate signal GW1 and the turn-on voltage level period of the second gate signal GW2 do not overlap exists in the normal non-light-emitting period IP+CWP of an image frame, the fourth node N4 between the first compensation transistor CT1 and the second compensation transistor CT2 may be out of the floating state in the period where the turn-on voltage level period of the first gate signal GW1 and the turn-on voltage level period of the second gate signal GW2 do not overlap. As a result, the first leakage current LC1 flowing from the fourth node N4 to the first node N1 through the first compensation transistor CT1 may be reduced. Similarly, because a period where the turn-on voltage level period of the first initialization signal GI1 and the turn-on voltage level period of the second initialization signal GI2 do not overlap exists in the normal non-light-emitting period IP+CWP of an image frame, the fifth node N5 between the first initialization transistor IT1 and the second initialization transistor IT2 may be out of the floating state in the period where the turn-on voltage level period of the first initialization signal GI1 and the turn-on voltage level period of the second initialization signal GI2 do not overlap. As a result, the second leakage current LC2 flowing from the fifth node N5 to the first node N1 through the first initialization transistor IT1 may be reduced.

Figure 12:
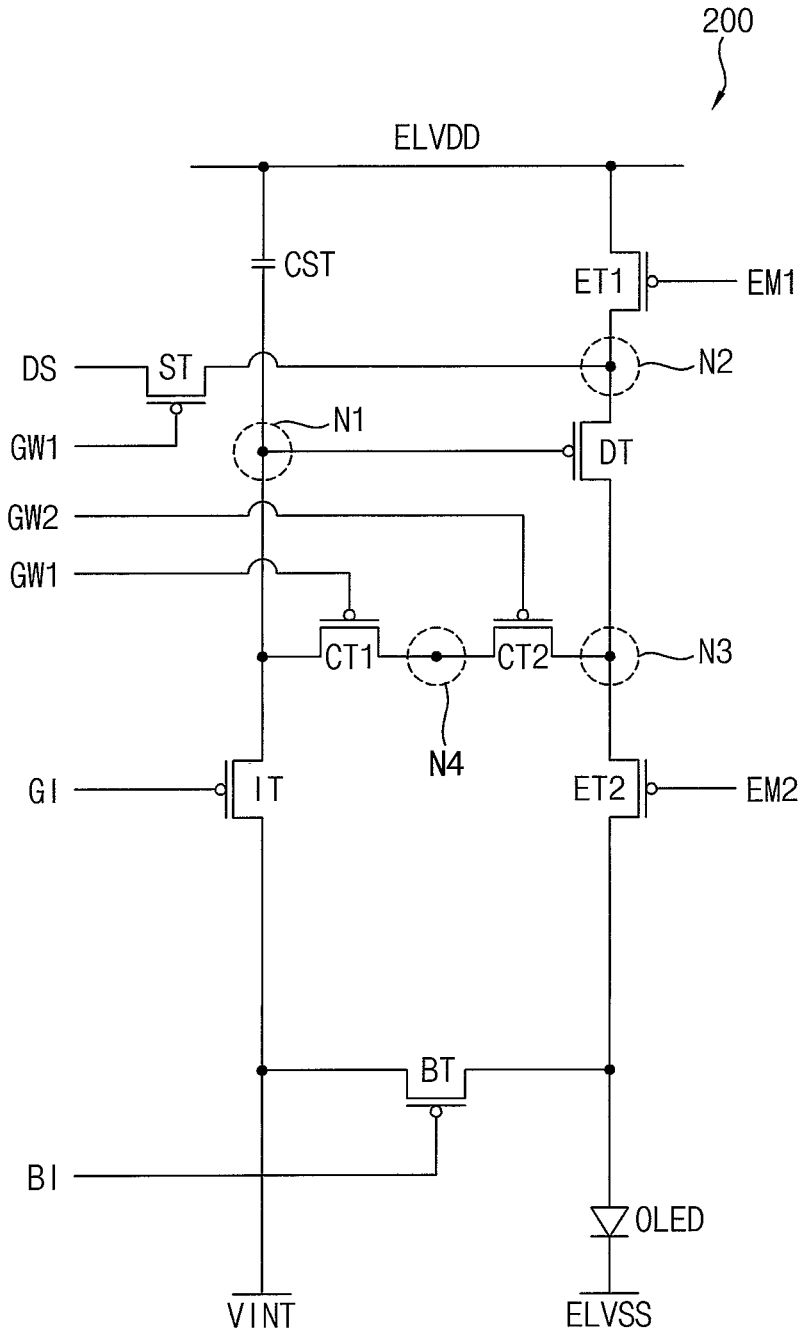
FIG. 12 is a circuit diagram illustrating further details of an example of the pixel circuit of FIG. 1 according to some example embodiments.

FIG. 12 is a circuit diagram illustrating further details of an example of the pixel circuit of FIG. 1 according to some example embodiments.

Referring to FIG. 12, the pixel circuit 200 may include the main circuit and the sub circuit. Here, the main circuit may control the organic light-emitting element OLED to emit light by controlling the driving current corresponding to the data signal DS that is applied via the data line to flow into the organic light-emitting element OLED. For example, the main circuit may include the organic light-emitting element OLED, the storage capacitor CST, the switching transistor ST, the driving transistor DT, the first emission control transistor ET1, and the second emission control transistor ET2. In some example embodiments, the main circuit may include only one of the first emission control transistor ET1 and the second emission control transistor ET2. The sub circuit may perform the initializing operation and the threshold voltage compensating operation of the pixel circuit 200. For example, the sub circuit may include the first compensation transistor CT1, the second compensation transistor CT2, the initialization transistor IT, and the bypass transistor BT. In some example embodiments, the main circuit may not include the bypass transistor BT. Except that the initialization transistor IT does not have the dual structure in the pixel circuit 200, the pixel circuit 200 may be substantially the same as the pixel circuit 100 of FIG. 2. Thus, the duplicated description therebetween will not be repeated. The initialization transistor IT may include a gate terminal that receives the initialization signal GI, a first terminal that is connected to the first node N1, and a second terminal that receives the initialization voltage VINT. As described above, in the low-frequency driving mode of the organic light-emitting display device, the driving frequency of the first gate signal GW1 may be N Hz, which is higher than the driving frequency of the organic light-emitting display device, the driving frequency of the second gate signal GW2 may be M Hz, which is the driving frequency of the organic light-emitting display device, the first compensation transistor CT1 may be turned on during a time (e.g., a set or predetermined time) in N non-light-emitting periods per second, and the second compensation transistor CT2 may be turned on during a time (e.g., a set or predetermined time) in M non-light-emitting periods per second. Here, the driving frequency of the first gate signal GW1 may be higher than the driving frequency of the second gate signal GW2 (i.e., N>M). In addition, in the low-frequency driving mode of the organic light-emitting display device, the driving frequency of the initialization signal GI may be M Hz, which is the driving frequency of the organic light-emitting display device, and the initialization transistor IT may be turned on during a time (e.g., a set or predetermined time) in M non-light-emitting periods per second. In brief, the pixel circuit 200 may have a structure in which the first compensation transistor CT1 and the second compensation transistor CT2 are connected in series between the gate terminal of the driving transistor DT (i.e., the first node N1) and one terminal of the driving transistor DT (i.e., the third node N3), where one terminal of the first compensation transistor CT1 is connected to the gate terminal of the driving transistor DT and one terminal of the second compensation transistor CT2 is connected to one terminal of the driving transistor DT. Based on the structure, in the low-frequency driving mode of the organic light-emitting display device, the pixel circuit 200 may turn on the first compensation transistor CT1 during a time (e.g., a set or predetermined time) in N non-light-emitting periods per second (i.e., the driving frequency of the first gate signal GW1 that controls the first compensation transistor CT1 may be N Hz, which is higher than the driving frequency of the organic light-emitting display device) and may turn on the second compensation transistor CT2 during a time (e.g., a set or predetermined time) in M non-light-emitting periods per second (i.e., the driving frequency of the second gate signal GW2 that controls the second compensation transistor CT2 may be M Hz, which is the driving frequency of the organic light-emitting display device). Hence, when the organic light-emitting display device operates in the low-frequency driving mode, in some non-light-emitting periods (i.e., the hold non-light-emitting periods), only the first compensation transistor CT1 may be turned on during a time (e.g., a set or predetermined time), and thus the fourth node N4 between the first compensation transistor CT1 and the second compensation transistor CT2 may be out of the floating state. As a result, when the organic light-emitting display device operates in the low-frequency driving mode, in some non-light-emitting periods (i.e., the hold non-light-emitting periods), the pixel circuit 200 may minimize (or reduce) the leakage current flowing from the fourth node N4 between the first compensation transistor CT1 and the second compensation transistor CT2 into the first node N1 through the first compensation transistor CT1 and thus may prevent or reduce a recognizable flicker from occurring.

Figure 13:
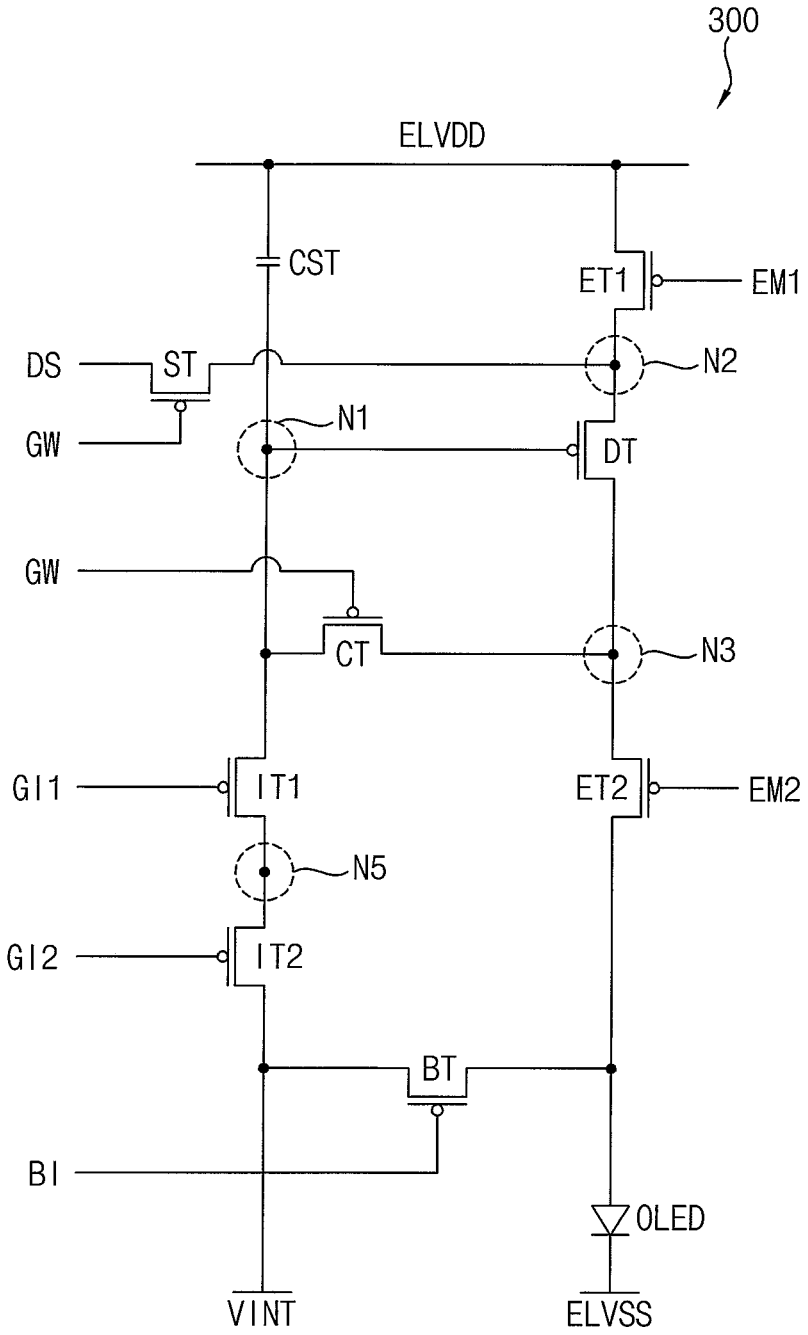
FIG. 13 is a circuit diagram illustrating further details of an example of the pixel circuit of FIG. 1 according to some example embodiments.

FIG. 13 is a circuit diagram illustrating further details of the pixel circuit of FIG. 1 according to some example embodiments.

Referring to FIG. 13, the pixel circuit 300 may include the main circuit and the sub circuit. Here, the main circuit may control the organic light-emitting element OLED to emit light by controlling the driving current corresponding to the data signal DS that is applied via the data line to flow into the organic light-emitting element OLED. For example, the main circuit may include the organic light-emitting element OLED, the storage capacitor CST, the switching transistor ST, the driving transistor DT, the first emission control transistor ET1, and the second emission control transistor ET2. In some example embodiments, the main circuit may include only one of the first emission control transistor ET1 and the second emission control transistor ET2. The sub circuit may perform the initializing operation and the threshold voltage compensating operation of the pixel circuit 300. For example, the sub circuit may include the compensation transistor CT, the first initialization transistor IT1, the second initialization transistor IT2, and the bypass transistor BT. In some example embodiments, the main circuit may not include the bypass transistor BT. Except that the compensation transistor CT does not have the dual structure in the pixel circuit 300, the pixel circuit 300 may be substantially the same as the pixel circuit 100 of FIG. 2. Thus, the duplicated description therebetween will not be repeated. The compensation transistor CT may include a gate terminal that receives the gate signal GW, a first terminal that is connected to the first node N1, and a second terminal that is connected to the third node N3. As described above, in the low-frequency driving mode of the organic light-emitting display device, the driving frequency of the first initialization signal GI1 may be N Hz, which is higher than the driving frequency of the organic light-emitting display device, the driving frequency of the second initialization signal GI2 may be M Hz, which is the driving frequency of the organic light-emitting display device, the first initialization transistor IT1 may be turned on during a time (e.g., a set or predetermined time) in N non-light-emitting periods per second, and the second initialization transistor IT2 may be turned on during a time (e.g., a set or predetermined time) in M non-light-emitting periods per second. Here, the driving frequency of the first initialization signal GI1 may be higher than the driving frequency of the second initialization signal GI2 (i.e., N>M). In addition, in the low-frequency driving mode of the organic light-emitting display device, the driving frequency of the gate signal GW may be M Hz, and the compensation transistor CT may be turned on during a time (e.g., a set or predetermined time) in M non-light-emitting periods per second. In brief, the pixel circuit 300 may have a structure in which the first initialization transistor IT1 and the second initialization transistor IT2 are connected in series between the gate terminal of the driving transistor DT (i.e., the first node N1) and the initialization voltage line transferring the initialization voltage VINT, where one terminal of the first initialization transistor IT1 is connected to the gate terminal of the driving transistor DT and one terminal of the second initialization transistor IT2 is connected to the initialization voltage line transferring the initialization voltage VINT. Based on the structure, in the low-frequency driving mode of the organic light-emitting display device, the pixel circuit 300 may turn on the first initialization transistor IT1 during a time (e.g., a set or predetermined time) in N non-light-emitting periods per second (i.e., the driving frequency of the first initialization signal GI1 that controls the first initialization transistor IT1 may be N Hz, which is higher than the driving frequency of the organic light-emitting display device) and may turn on the second initialization transistor IT2 during a time (e.g., a set or predetermined time) in M non-light-emitting periods per second (i.e., the driving frequency of the second initialization signal GI2 that controls the second initialization transistor IT2 may be M Hz, which is the driving frequency of the organic light-emitting display device). Hence, when the organic light-emitting display device operates in the low-frequency driving mode, in some non-light-emitting periods (i.e., the hold non-light-emitting periods), only the first initialization transistor IT1 may be turned on during a time (e.g., a set or predetermined time), and thus the fifth node N5 between the first initialization transistor IT1 and the second initialization transistor IT2 may be out of the floating state. As a result, when the organic light-emitting display device operates in the low-frequency driving mode, in some non-light-emitting periods (i.e., the hold non-light-emitting periods), the pixel circuit 300 may minimize (or reduce) the leakage current flowing from the fifth node N5 between the first initialization transistor IT1 and the second initialization transistor IT2 to the first node N1 through the first initialization transistor IT1 and thus may prevent or reduce a recognizable flicker from occurring.

Figure 14:
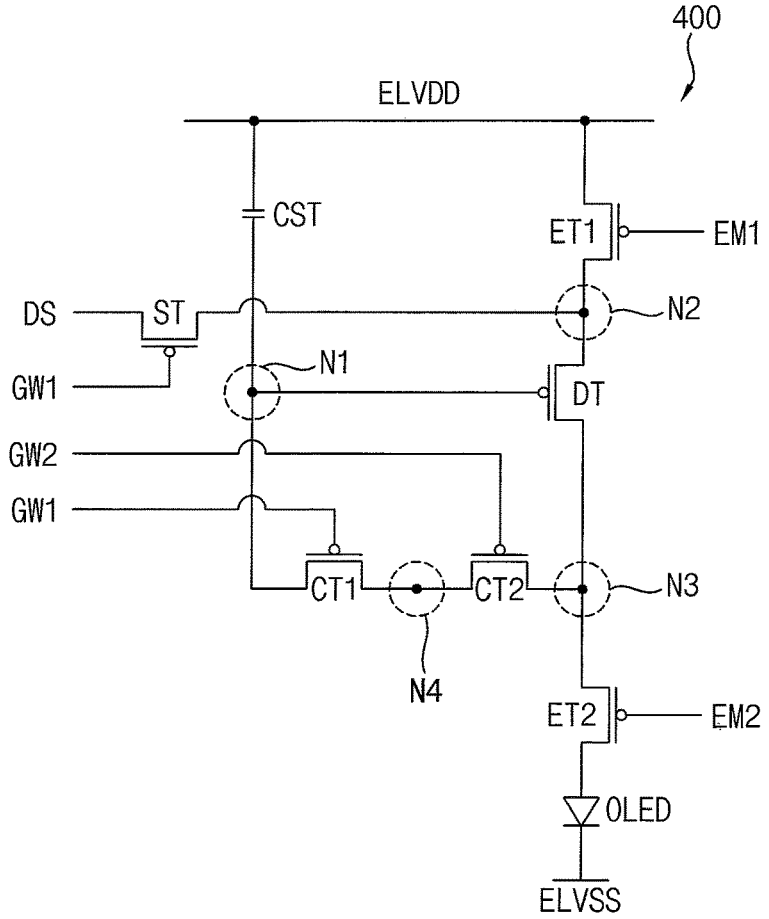
FIG. 14 is a circuit diagram illustrating further details of an example of the pixel circuit of FIG. 1 according to some example embodiments.

FIG. 14 is a circuit diagram illustrating further details of the pixel circuit of FIG. 1 according to some example embodiments.

Referring to FIG. 14, the pixel circuit 400 may include the main circuit and the sub circuit. Here, the main circuit may control the organic light-emitting element OLED to emit light by controlling the driving current corresponding to the data signal DS that is applied via the data line to flow into the organic light-emitting element OLED. For example, the main circuit may include the organic light-emitting element OLED, the storage capacitor CST, the switching transistor ST, the driving transistor DT, the first emission control transistor ET1, and the second emission control transistor ET2. In some example embodiments, the main circuit may include only one of the first emission control transistor ET1 and the second emission control transistor ET2. The sub circuit may perform the threshold voltage compensating operation of the pixel circuit 400. For example, the sub circuit may include the first compensation transistor CT1 and the second compensation transistor CT2. Except that the pixel circuit 400 does not include the first initialization transistor IT1, the second initialization transistor IT2, and the bypass transistor BT, the pixel circuit 400 may be substantially the same as the pixel circuit 100 of FIG. 2. Thus, the duplicated description therebetween will not be repeated. As described above, in the low-frequency driving mode of the organic light-emitting display device, the driving frequency of the first gate signal GW1 may be N Hz, which is higher than the driving frequency of the organic light-emitting display device, the driving frequency of the second gate signal GW2 may be M Hz, which is the driving frequency of the organic light-emitting display device, the first compensation transistor CT1 may be turned on during a time (e.g., a set or predetermined time) in N non-light-emitting periods per second, and the second compensation transistor CT2 may be turned on during a time (e.g., a set or predetermined time) in M non-light-emitting periods per second. Here, the driving frequency of the first gate signal GW1 may be higher than the driving frequency of the second gate signal GW2 (i.e., N>M). In brief, the pixel circuit 400 may have a structure in which the first compensation transistor CT1 and the second compensation transistor CT2 are connected in series between the gate terminal of the driving transistor DT (i.e., the first node N1) and one terminal of the driving transistor DT (i.e., the third node N3), where one terminal of the first compensation transistor CT1 is connected to the gate terminal of the driving transistor DT and one terminal of the second compensation transistor CT2 is connected to one terminal of the driving transistor DT. Based on the structure, in the low-frequency driving mode of the organic light-emitting display device, the pixel circuit 400 may turn on the first compensation transistor CT1 during a time (e.g., a set or predetermined time) in N non-light-emitting periods per second (i.e., the driving frequency of the first gate signal GW1 that controls the first compensation transistor CT1 may be N Hz, which is higher than the driving frequency of the organic light-emitting display device) and may turn on the second compensation transistor CT2 during a time (e.g., a set or predetermined time) in M non-light-emitting periods per second (i.e., the driving frequency of the second gate signal GW2 that controls the second compensation transistor CT2 may be M Hz, which is the driving frequency of the organic light-emitting display device). Hence, when the organic light-emitting display device operates in the low-frequency driving mode, in some non-light-emitting periods (i.e., the hold non-light-emitting periods), only the first compensation transistor CT1 may be turned on during a time (e.g., a set or predetermined time), and thus the fourth node N4 between the first compensation transistor CT1 and the second compensation transistor CT2 may be out of the floating state. As a result, when the organic light-emitting display device operates in the low-frequency driving mode, in some non-light-emitting periods (i.e., the hold non-light-emitting periods), the pixel circuit 400 may minimize (or reduce) the leakage current flowing from the fourth node N4 between the first compensation transistor CT1 and the second compensation transistor CT2 into the first node N1 through the first compensation transistor CT1 and thus may prevent or reduce a recognizable flicker from occurring.

Figure 15:
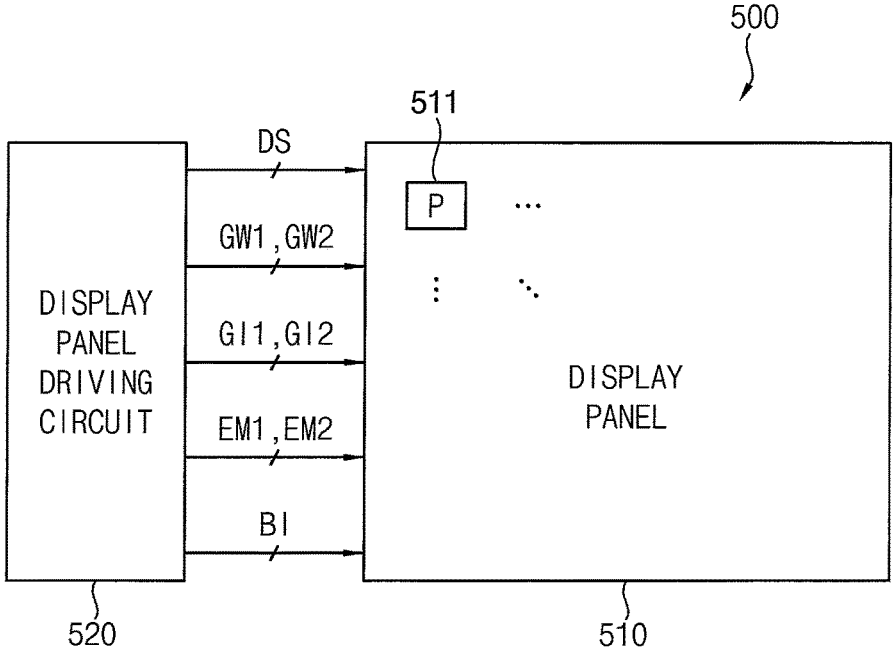
FIG. 15 is a block diagram illustrating an organic light-emitting display device according to some example embodiments.

FIG. 15 is a block diagram illustrating an organic light-emitting display device according to example embodiments.

Referring to FIG. 15, the organic light-emitting display device 500 may include a display panel 510 and a display panel driving circuit 520.

The display panel 510 may include a plurality of pixel circuits 511. Each of the pixel circuits 511 may include a main circuit and a sub circuit. The main circuit may allow a driving current corresponding to a data signal DS applied via a data line to flow into an organic light-emitting element so that the organic light-emitting element may emit light. For example, the main circuit may include the organic light-emitting element, a storage capacitor, a switching transistor, a driving transistor, a first emission control transistor, and a second emission control transistor. In some example embodiments, the main circuit may include only one of the first emission control transistor and the second emission control transistor. The sub circuit may perform an initializing operation and/or a threshold voltage compensating operation of the pixel circuit 511. For example, the sub circuit may include a first compensation transistor, a second compensation transistor, a first initialization transistor, a second initialization transistor, and a bypass transistor. According to some example embodiments, the sub circuit may include a first compensation transistor, a second compensation transistor, an initialization transistor, and a bypass transistor. According to some example embodiments, the sub circuit may include a compensation transistor, a first initialization transistor, a second initialization transistor, and a bypass transistor. According to some example embodiments, the sub circuit may include a first compensation transistor and a second compensation transistor. Because these structures are example, the sub circuit may be variously designed to have a compensation transistor having a dual structure and/or an initialization transistor having a dual structure. In a low-frequency driving mode of the organic light-emitting display device 500, a driving frequency of a first gate signal GW1 that controls the first compensation transistor may be N Hz, which is higher than a driving frequency of the organic light-emitting display device 500, a driving frequency of a second gate signal GW2 that controls the second compensation transistor may be M Hz, which is the driving frequency of the organic light-emitting display device 500, the first compensation transistor may be turned on during a time (e.g., a set or predetermined time) in N non-light-emitting periods per second, and the second compensation transistor may be turned on during a time (e.g., a set or predetermined time) in M non-light-emitting periods per second. In addition, in the low-frequency driving mode of the organic light-emitting display device 500, a driving frequency of a first initialization signal GI1 that controls the first initialization transistor may be N Hz, which is higher than the driving frequency of the organic light-emitting display device 500, a driving frequency of a second initialization signal GI2 that controls the second initialization transistor may be M Hz, which is the driving frequency of the organic light-emitting display device 500, the first initialization transistor may be turned on during a time (e.g., a set or predetermined time) in N non-light-emitting periods per second, and the second initialization transistor may be turned on during a time (e.g., a set or predetermined time) in M non-light-emitting periods per second. Because these are described above, duplicated description related thereto will not be repeated.

The display panel driving circuit 520 may provide various signals DS, GW1, GW2, GI1, GI2, EM1, EM2, and BI to the display panel 510 so that the display panel 510 may operate. That is, the display panel driving circuit 520 may drive the display panel 510. According to some example embodiments, the display panel driving circuit 520 may include a first gate signal generating circuit, a second gate signal generating circuit, a first initialization signal generating circuit, a second initialization signal generating circuit, a data signal generating circuit, an emission control signal generating circuit, a bypass signal generating circuit, a timing control circuit, etc. The first gate signal generating circuit may generate the first gate signal GW1 having the driving frequency of N Hz. The second gate signal generating circuit may generate the second gate signal GW2 having the driving frequency of M Hz. The first initialization signal generating circuit may generate the first initialization signal GI1 having the driving frequency of N Hz. The second initialization signal generating circuit may generate the second initialization signal GI2 having the driving frequency of M Hz. The data signal generating circuit may generate the data signal DS. The emission control signal generating circuit may generate the first emission control signal EM1 and the second emission control signal EM2. According to some example embodiments, the first emission control signal EM1 may be the same as the second emission control signal EM2. According to some example embodiments, the first emission control signal EM1 may be different from (or independent of) the second emission control signal EM2. The bypass signal generating circuit may generate the bypass signal BI. The timing control circuit may generate a plurality of control signals to control the first gate signal generating circuit, the second gate signal generating circuit, the first initialization signal generating circuit, the second initialization signal generating circuit, the data signal generating circuit, the emission control signal generating circuit, the bypass signal generating circuit, etc. In some example embodiments, the timing control circuit may receive image data, may perform a specific data processing (e.g., deterioration compensation, etc.) on the image data, and may provide the processed image data to the data signal generating circuit. As described above, the organic light-emitting display device 500 may have a structure including the first compensation transistor and the second compensation transistor that are connected in series between a gate terminal of a driving transistor and one terminal of the driving transistor or a structure including a compensation transistor between the gate terminal of the driving transistor and one terminal of the driving transistor and/or may have a structure including the first initialization transistor and the second initialization transistor that are connected in series between the gate terminal of the driving transistor and an initialization voltage line transferring an initialization voltage or a structure including an initialization transistor between the gate terminal of the driving transistor and the initialization voltage line transferring the initialization voltage. Here, in the low-frequency driving mode of the organic light-emitting display device 500, each pixel circuit 511 of the organic light-emitting display device 500 may turn on the first compensation transistor and/or the first initialization transistor during a time (e.g., a set or predetermined time) in N non-light-emitting periods per second and may turn on the second compensation transistor and/or the second initialization transistor during a time (e.g., a set or predetermined time) in M non-light-emitting periods per second. Thus, the organic light-emitting display device 500 may prevent or reduce a flicker that a viewer can recognize from occurring when the organic light-emitting display device 500 operates in the low-frequency driving mode. As a result, the organic light-emitting display device 500 may provide a relatively high-quality image to the viewer.

Figure 16:
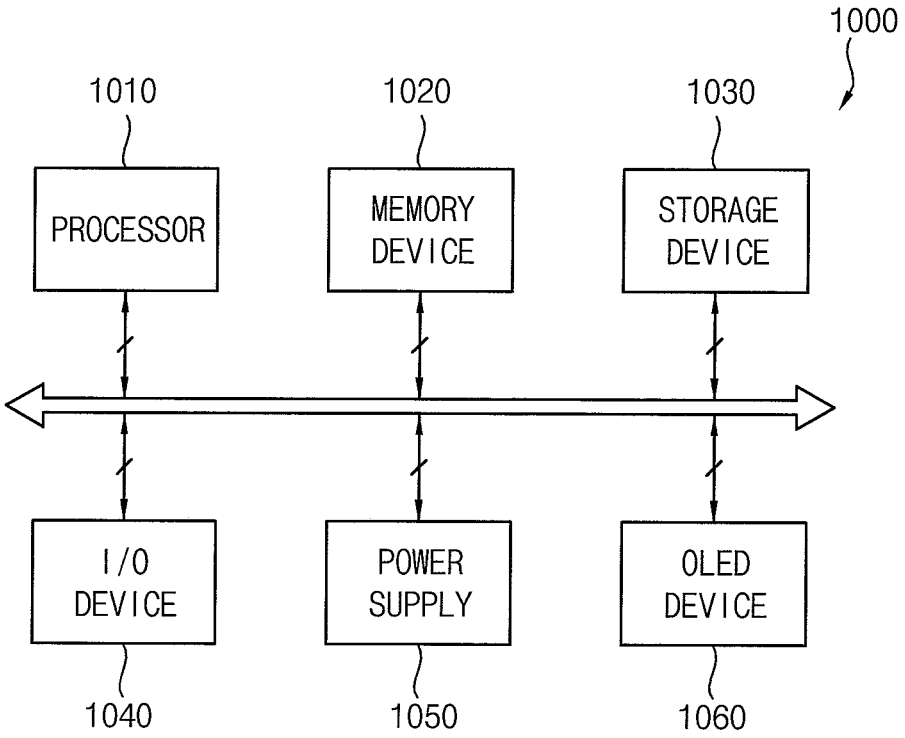
FIG. 16 is a block diagram illustrating an electronic device according to some example embodiments.
Figure 17:
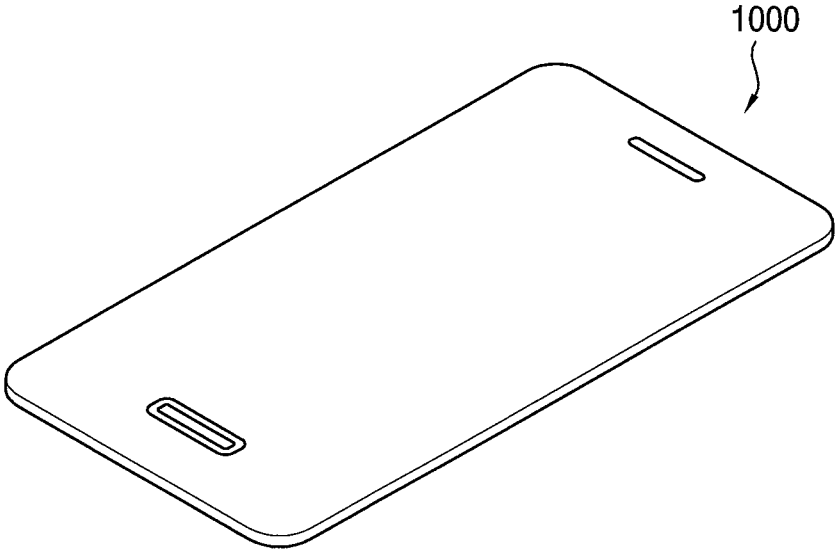
FIG. 17 is a diagram illustrating an example in which the electronic device of FIG. 16 is implemented as a smart phone according to some example embodiments.

FIG. 16 is a block diagram illustrating an electronic device according to example embodiments, and FIG. 17 is a diagram illustrating an example in which the electronic device of FIG. 16 is implemented as a smart phone.

Referring to FIGS. 16 and 17, the electronic device 1000 may include a processor 1010, a memory device 1020, a storage device 1030, an input/output (I/O) device 1040, a power supply 1050, and an organic light-emitting display device 1060. Here, the organic light-emitting display device 1060 may be the organic light-emitting display device 500 of FIG. 15. In addition, the electronic device 1000 may further include a plurality of ports for communicating with a video card, a sound card, a memory card, a universal serial bus (USB) device, other electronic devices, etc. According to some example embodiments, as illustrated in FIG. 17, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display (HMD) device, etc.

The processor 1010 may perform various computing functions. The processor 1010 may be a micro processor, a central processing unit (CPU), an application processor (AP), etc. The processor 1010 may be coupled to other components via an address bus, a control bus, a data bus, etc.

Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc. and/or at least one volatile memory device such as a dynamic random access memory (DRAM) device, a static random access memory (SRAM) device, a mobile DRAM device, etc. The storage device 1030 may include a solid state drive (SSD) device, a hard disk drive (HDD) device, a CD-ROM device, etc. The I/O device 1040 may include an input device such as a keyboard, a keypad, a mouse device, a touch-pad, a touch-screen, etc., and an output device such as a printer, a speaker, etc. In some example embodiments, the I/O device 1040 may include the organic light-emitting display device 1060. The power supply 1050 may provide power for operations of the electronic device 1000. The organic light-emitting display device 1060 may be coupled to other components via the buses or other communication links.

As described above, the organic light-emitting display device 1060 may include a display panel that includes pixel circuits and a display panel driving circuit that drives the display panel. Here, each of the pixel circuits included in the organic light-emitting display device 1060 may have a structure including a first compensation transistor and a second compensation transistor that are connected in series between a gate terminal of a driving transistor and one terminal of the driving transistor (here, one terminal of the first compensation transistor is connected to the gate terminal of the driving transistor, and one terminal of the second compensation transistor is connected to the one terminal of the driving transistor) or a structure including a compensation transistor that is connected between the gate terminal of the driving transistor and the one terminal of the driving transistor.

In addition, each of the pixel circuits included in the organic light-emitting display device 1060 may have a structure including a first initialization transistor and a second initialization transistor that are connected in series between the gate terminal of the driving transistor and an initialization voltage line transferring an initialization voltage (here, one terminal of the first initialization transistor is connected to the gate terminal of the driving transistor, and one terminal of the second initialization transistor is connected to the initialization voltage line transferring the initialization voltage) or a structure including an initialization transistor that is connected between the gate terminal of the driving transistor and the initialization voltage line transferring the initialization voltage. Based on the structures, each of the pixel circuits included in the organic light-emitting display device 1060 may turn on the first compensation transistor and/or the first initialization transistor during a time (e.g., a set or predetermined time) in N non-light-emitting periods per second when the organic light-emitting display device 1060 operates in a low-frequency driving mode (i.e., a driving frequency of a first gate signal that controls the first compensation transistor and a driving frequency of a first initialization signal that controls the first initialization transistor may be N Hz, which is higher than a driving frequency of the organic light-emitting display device 1060), and may turn on the second compensation transistor and/or the second initialization transistor during a time (e.g., a set or predetermined time) in M non-light-emitting periods per second when the organic light-emitting display device 1060 operates in the low-frequency driving mode (i.e., a driving frequency of a second gate signal that controls the second compensation transistor and a driving frequency of a second initialization signal that controls the second initialization transistor may be M Hz, which is the driving frequency of the organic light-emitting display device 1060).

As a result, each of the pixel circuits included in the organic light-emitting display device 1060 may minimize (or reduce) a leakage current flowing through the first compensation transistor and/or the first initialization transistor when the organic light-emitting display device 1060 operates in the low-frequency driving mode and thus may prevent (or reduce) a flicker that a viewer can recognize (i.e., may prevent or reduce a change in a voltage of the gate terminal of the driving transistor). Thus, the organic light-emitting display device 1060 may provide a high-quality image to the viewer. Because the pixel circuit is described above, duplicated description related thereto will not be repeated.

The present inventive concept may be applied to an organic light-emitting display device and an electronic device including the organic light-emitting display device. For example, the present inventive concept may be applied to a smart phone, a cellular phone, a video phone, a smart pad, a smart watch, a tablet PC, a car navigation system, a television, a computer monitor, a laptop, a head mounted display device, an MP3 player, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and characteristics of embodiments according to the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A pixel circuit comprising:

a main circuit including:

a driving transistor that includes a gate terminal connected to a first node, a first terminal connected to a second node, and a second terminal connected to a third node; and an organic light-emitting element connected to the driving transistor between a first power voltage and a second power voltage and configured to control the organic light-emitting element to emit light by controlling a driving current corresponding to a data signal applied via a data line to flow into the organic light-emitting element; and a sub circuit including:

a first compensation transistor that includes a gate terminal configured to receive a first gate signal, a first terminal connected to the first node, and a second terminal connected to a fourth node; and a second compensation transistor that includes a gate terminal configured to receive a second gate signal, a first terminal connected to the fourth node, and a second terminal connected to the third node, wherein in a low-frequency driving mode, a driving frequency of the first gate signal is N hertz (Hz), where N is a positive integer, a driving frequency of the second gate signal is M Hz, which is a driving frequency of an organic light-emitting display device, where M is a positive integer and different from N, the first compensation transistor is configured to be turned on during a predetermined time in N non-light-emitting periods per second, and the second compensation transistor is configured to be turned on during a predetermined time in M non-light-emitting periods per second.

2. The pixel circuit of claim 1, wherein in the low-frequency driving mode, the driving frequency of the first gate signal is higher than the driving frequency of the second gate signal.

3. The pixel circuit of claim 2, wherein respective signal generating circuits that are independent of each other are configured to generate the first gate signal and the second gate signal.

4. The pixel circuit of claim 1, wherein the sub circuit further includes:

a first initialization transistor including a gate terminal configured to receive a first initialization signal, a first terminal connected to the first node, and a second terminal connected to a fifth node; and a second initialization transistor including a gate terminal configured to receive a second initialization signal, a first terminal connected to the fifth node, and a second terminal configured to receive an initialization voltage, and wherein in the low-frequency driving mode, a driving frequency of the first initialization signal is N Hz, a driving frequency of the second initialization signal is M Hz, the first initialization transistor is configured to be turned on during a predetermined time in N non-light-emitting periods per second, and the second initialization transistor is configured to be turned on during a predetermined time in M non-light-emitting periods per second.

5. The pixel circuit of claim 4, wherein respective signal generating circuits that are independent of each other are configured to generate the first initialization signal and the second initialization signal.

6. The pixel circuit of claim 4, wherein the first compensation transistor and the second compensation transistor are configured to be, in a normal non-light-emitting period in which an initializing operation and a threshold voltage compensating and data writing operation are performed, turned on and then off after the first initialization transistor and the second initialization transistor are turned on and then off.

7. The pixel circuit of claim 6, wherein the first compensation transistor is configured to be, in a hold non-light-emitting period in which the initializing operation and the threshold voltage compensating and data writing operation are not performed, turned on and then off after the first initialization transistor is turned on and then off.

8. The pixel circuit of claim 1, wherein the sub circuit further includes an initialization transistor including a gate terminal configured to receive an initialization signal, a first terminal connected to the first node, and a second terminal configured to receive an initialization voltage, and wherein in the low-frequency driving mode, a driving frequency of the initialization signal is M Hz, and the initialization transistor is configured to be turned on during a predetermined time in M non-light-emitting periods per second.

9. The pixel circuit of claim 8, wherein the first compensation transistor and the second compensation transistor are configured to be, in a normal non-light-emitting period in which an initializing operation and a threshold voltage compensating and data writing operation are performed, turned on and then off after the initialization transistor is turned on and then off.

10. The pixel circuit of claim 9, wherein the first compensation transistor is configured to be, in a hold non-light-emitting period in which the initializing operation and the threshold voltage compensating and data writing operation are not performed, turned on and then off.

11. The pixel circuit of claim 1, wherein the main circuit further includes:

a switching transistor including a gate terminal configured to receive the first gate signal, a first terminal connected to the data line, and a second terminal connected to the second node;

a storage capacitor including a first terminal configured to receive the first power voltage and a second terminal connected to the first node;

a first emission control transistor including a gate terminal configured to receive a first emission control signal, a first terminal configured to receive the first power voltage, and a second terminal connected to the second node; and a second emission control transistor including a gate terminal configured to receive a second emission control signal, a first terminal connected to the third node, and a second terminal connected to an anode of the organic light-emitting element.

12. The pixel circuit of claim 1, wherein the sub circuit further includes a bypass transistor including a gate terminal configured to receive a bypass signal, a first terminal configured to receive an initialization voltage, and a second terminal connected to an anode of the organic light-emitting element.

13. A pixel circuit comprising:

a main circuit including:

a driving transistor that includes a gate terminal connected to a first node, a first terminal connected to a second node, and a second terminal connected to a third node; and an organic light-emitting element connected to the driving transistor between a first power voltage and a second power voltage and configured to control the organic light-emitting element to emit light by controlling a driving current corresponding to a data signal applied via a data line to flow into the organic light-emitting element; and a sub circuit including:

a first initialization transistor that includes a gate terminal configured to receive a first initialization signal, a first terminal connected to the first node, and a second terminal connected to a fifth node;

a second initialization transistor that includes a gate terminal configured to receive a second initialization signal, a first terminal connected to the fifth node, and a second terminal configured to receive an initialization voltage; and a compensation transistor that includes a gate terminal configured to receive a gate signal, a first terminal connected to the first node, and a second terminal connected to the third node, wherein in a low-frequency driving mode, a driving frequency of the first initialization signal is N Hz, where N is a positive integer, a driving frequency of the second initialization signal is M Hz, which is a driving frequency of an organic light-emitting display device, where M is a positive integer and different from N, a driving frequency of the gate signal is M Hz, the first initialization transistor is configured to be turned on during a predetermined time in N non-light-emitting periods per second, the second initialization transistor is configured to be turned on during a predetermined time in M non-light-emitting periods per second, and the compensation transistor is configured to be turned on during a predetermined time in M non-light-emitting periods per second.

14. The pixel circuit of claim 13, wherein in the low-frequency driving mode, the driving frequency of the first initialization signal is higher than the driving frequency of the second initialization signal.

15. The pixel circuit of claim 14, wherein respective signal generating circuits that are independent of each other are configured to generate the first initialization signal and the second initialization signal.

16. The pixel circuit of claim 13, wherein in the low-frequency driving mode, the driving frequency of the first initialization signal is higher than the driving frequency of the gate signal.

17. The pixel circuit of claim 13, wherein the first initialization transistor is configured to be, in a normal non-light-emitting period in which an initializing operation and a threshold voltage compensating and data writing operation are performed, turned on and then off.

18. The pixel circuit of claim 17, wherein the compensation transistor is configured to be, in a hold non-light-emitting period in which the initializing operation and the threshold voltage compensating and data writing operation are not performed, turned on and then off after the first initialization transistor is turned on and then off.

19. The pixel circuit of claim 13, wherein the main circuit further includes:

a switching transistor including a gate terminal configured to receive the gate signal, a first terminal connected to the data line, and a second terminal connected to the second node;

a storage capacitor including a first terminal configured to receive the first power voltage and a second terminal connected to the first node;

a first emission control transistor including a gate terminal configured to receive a first emission control signal, a first terminal configured to receive the first power voltage, and a second terminal connected to the second node; and a second emission control transistor including a gate terminal configured to receive a second emission control signal, a first terminal connected to the third node, and a second terminal connected to an anode of the organic light-emitting element.

20. The pixel circuit of claim 13, wherein the sub circuit further includes a bypass transistor including a gate terminal configured to receive a bypass signal, a first terminal configured to receive the initialization voltage, and a second terminal connected to an anode of the organic light-emitting element.

* * * * *